US011434613B2

(12) United States Patent
Colquhoun et al.

(10) Patent No.: US 11,434,613 B2
(45) Date of Patent: Sep. 6, 2022

(54) BARRIER CONSTRUCTION

(71) Applicant: Industrial Galvanizers Corporation Pty Ltd, Minto (AU)

(72) Inventors: Terry Colquhoun, Mt. Keira (AU); Hayden Wallace, Smeaton Grange (AU); Andrew Karl Diehl, Christchurch (NZ); Christopher James Allington, Leeston (NZ); Chris Williamson, Christchurch (NZ); Mark Whiteside, Christchurch (NZ); Henry John Hare, Christchurch (NZ); Wouter Von Toor, Christchurch (NZ); Ryan Ayres, Alexandria (NZ); John Rafferty, Wangi Wangi (AU)

(73) Assignee: Industrial Galvanizers Corporation Pty Ltd., Minto (AU)

( * ) Notice: Subject to any disclaimer, the term of this patent is extended or adjusted under 35 U.S.C. 154(b) by 192 days.

(21) Appl. No.: 16/735,567

(22) Filed: Jan. 6, 2020

(65) Prior Publication Data

US 2020/0141076 A1 May 7, 2020

Related U.S. Application Data

(62) Division of application No. 16/400,748, filed on May 1, 2019, now Pat. No. 10,544,554, which is a division (Continued)

(30) Foreign Application Priority Data

May 30, 2011 (AU) ..... 2011902086

(51) Int. Cl.
*E01F 15/04* (2006.01)
*E01F 9/669* (2016.01)

(Continued)

(52) U.S. Cl.
CPC ..... *E01F 15/0461* (2013.01); *E01F 9/61* (2016.02); *E01F 9/619* (2016.02); *E01F 9/669* (2016.02);

(Continued)

(58) Field of Classification Search
CPC ..... E01F 15/0461; E01F 15/0484; E01F 9/60; E01F 9/61; E01F 9/658; E01F 9/669;

(Continued)

(56) References Cited

U.S. PATENT DOCUMENTS 319,277 A 6/1885 Lesher
1,919,984 A * 7/1933 Murphy ..... H01J 19/00 445/47

(Continued)

FOREIGN PATENT DOCUMENTS

DE 3640821 C1 3/1988
EP 0307796 A1 3/1989

(Continued)

OTHER PUBLICATIONS

European Patent Office Espacenet, English abstract of DE3640821 (C1), printed on Jun. 28, 2018.

(Continued)

*Primary Examiner* — Jonathan P Masinick
(74) *Attorney, Agent, or Firm* — Cahn & Samuels, LLP

(57) ABSTRACT

The present invention relates to posts, carriages, methods of manufacturing the components and their assembly into a barrier. The invention also includes a Z post attachment includes an attachment tab 8.016 and end engagement flange 8.024, 8.026 adapted to engage the end of the post. The arrangement can include a delineator 8.030 which is skew in relation to the tab 8.016, so as to provide reflector faces 8.032 which face oncoming traffic.

11 Claims, 34 Drawing Sheets

Related U.S. Application Data of application No. 15/490,537, filed on Apr. 18, 2017, now Pat. No. 10,329,722, which is a division of application No. 14/122,952, filed as application No. PCT/AU2012/000544 on May 16, 2012, now Pat. No. 9,631,331.

(51) Int. Cl.

| | |
|---|---|
| ***E01F 9/608*** | (2016.01) |
| ***E01F 9/619*** | (2016.01) |
| ***E04H 12/22*** | (2006.01) |
| ***E04H 17/22*** | (2006.01) |
| ***E04H 17/00*** | (2006.01) |

(52) U.S. Cl.

CPC ..... *E01F 15/0407* (2013.01); *E01F 15/0423* (2013.01); *E01F 15/0438* (2013.01); *E01F 15/0469* (2013.01); *E01F 15/0484* (2013.01); *E04H 12/2215* (2013.01); *E04H 17/22* (2013.01); *E04H 17/006* (2021.01)

(58) Field of Classification Search

CPC .... E01F 9/608; E04H 17/20; E04H 2017/006; E04H 12/22

See application file for complete search history.

(56) References Cited

U.S. PATENT DOCUMENTS

| | | | | |
|---|---|---|---|---|
| 2,025,014 | A | 12/1935 | Brickman et al. | |
| 2,317,249 | A | 4/1943 | Brickman | |
| 2,520,313 | A | 8/1950 | Harris | |
| 3,214,142 | A | 10/1965 | Brown et al. | |
| 3,353,795 | A | 11/1967 | Muller | |
| 3,388,892 | A | 6/1968 | Case | |
| 3,468,574 | A | 9/1969 | Schell, Jr. | |
| 3,493,213 | A | 2/1970 | Ackerman | |
| 3,617,076 | A | 11/1971 | Attwood | |
| 3,807,089 | A * | 4/1974 | Senese | A01G 17/06 47/46 |
| 3,950,846 | A * | 4/1976 | Johnson | H01H 13/702 29/882 |
| 3,981,486 | A | 9/1976 | Baumann | |
| 3,982,735 | A | 9/1976 | Fornells | |
| 4,158,998 | A | 6/1979 | Clement | |
| 4,252,472 | A * | 2/1981 | Moraly | E04H 17/263 173/126 |
| 4,759,161 | A | 7/1988 | Kucyk, Jr. et al. | |
| 5,125,194 | A | 6/1992 | Granger | |
| 5,152,507 | A | 10/1992 | Lee | |
| 5,172,891 | A | 12/1992 | Chen | |
| 5,188,342 | A | 2/1993 | Oullette et al. | |
| 5,219,241 | A | 6/1993 | Picton | |
| 5,297,890 | A | 3/1994 | Commins | |
| 5,429,449 | A | 7/1995 | Baatz | |
| 5,657,966 | A | 8/1997 | Cicinnati | |
| 5,660,375 | A | 8/1997 | Freeman | |
| 6,007,269 | A | 12/1999 | Marinelli | |
| 6,036,399 | A | 3/2000 | Schalk | |
| 6,168,346 | B1 | 1/2001 | Ernsberger | |
| 6,220,576 | B1 | 4/2001 | Chan | |
| 6,301,846 | B1 | 10/2001 | Waalkes et al. | |
| 6,502,805 | B2 | 1/2003 | Lewis et al. | |
| 6,516,573 | B1 | 2/2003 | Farrell et al. | |
| 6,557,829 | B1 | 5/2003 | Steffes | |
| 6,575,656 | B2 | 6/2003 | Suh | |
| 6,612,551 | B1 | 9/2003 | Roy | |
| 6,644,888 | B2 | 11/2003 | Ochoa | |
| 6,745,530 | B2 | 6/2004 | Nesbitt | |
| 6,962,328 | B2 | 11/2005 | Bergendahl | |
| 7,155,949 | B2 * | 1/2007 | Hellgren | B21D 22/12 72/63 |
| 7,229,050 | B2 | 6/2007 | Schloss | |
| 7,445,402 | B1 | 11/2008 | Chen | |
| 7,478,796 | B2 | 1/2009 | Burkett | |
| 7,530,548 | B2 | 5/2009 | Ochoa | |
| 7,699,293 | B2 | 4/2010 | James | |
| 7,731,159 | B2 | 6/2010 | Pericas | |
| 7,832,713 | B2 | 11/2010 | King | |
| 7,980,519 | B2 | 7/2011 | Chen | |
| 7,997,824 | B2 | 8/2011 | Pericas | |
| 8,353,499 | B2 | 1/2013 | Conway et al. | |
| 8,858,112 | B2 | 10/2014 | Wallace et al. | |
| 9,631,331 | B2 | 4/2017 | Colquhoun et al. | |
| 2001/0048846 | A1 | 12/2001 | Ochoa | |
| 2002/0053664 | A1 | 5/2002 | Moore | |
| 2005/0269558 | A1 | 12/2005 | Keefe | |
| 2007/0003361 | A1 | 1/2007 | Wang | |
| 2007/0245681 | A1 | 10/2007 | Patton | |
| 2008/0224114 | A1 | 9/2008 | Cheng | |
| 2009/0050863 | A1 | 2/2009 | Conway et al. | |
| 2009/0050864 | A1 | 2/2009 | Conway et al. | |
| 2009/0206308 | A1 | 8/2009 | Pericas | |
| 2010/0001247 | A1 | 1/2010 | Jaimes et al. | |
| 2010/0126106 | A1 | 5/2010 | Ivarsson | |
| 2011/0095250 | A1 | 4/2011 | Dyke et al. | |
| 2011/0126607 | A1 * | 6/2011 | Ewald | B21D 25/02 72/296 |
| 2012/0003039 | A1 | 1/2012 | Wallace et al. | |
| 2014/0110652 | A1 | 4/2014 | Leonhardt et al. | |

FOREIGN PATENT DOCUMENTS

| | | | |
|---|---|---|---|
| EP | 0554864 | A1 | 8/1993 |
| EP | 0708206 | A1 | 4/1996 |
| EP | 1650351 | B1 | 10/2005 |
| EP | 1813725 | A1 | 8/2007 |
| EP | 1857594 | B1 | 6/2010 |
| FR | 1570598 | | 6/1969 |
| GB | 2397604 | A | 7/2004 |
| JP | 2791288 | B2 | 8/1998 |
| JP | 2008128487 | A | 6/2008 |
| KR | 200300015 | Y1 | 1/2003 |
| KR | 200316380 | Y1 | 6/2003 |
| KR | 200341426 | Y1 | 2/2004 |
| KR | 20060073218 | A | 6/2006 |
| KR | 1020080109207 | A | 12/2008 |
| WO | 94/03678 | A1 | 2/1994 |
| WO | 2007079520 | A1 | 7/2007 |
| WO | 2009025997 | A2 | 2/2009 |
| WO | 2010105307 | A1 | 9/2010 |
| WO | 2011000127 | A1 | 1/2011 |

OTHER PUBLICATIONS

European Patent Office Espacenet, English abstract of EP1650351 (A2), printed on Jul. 10, 2018.

European Patent Office Espacenet, English abstract of EP1857594 (A1), printed on Jul. 10, 2018.

European Patent Office Espacenet, English abstract of EP0307796 (A1), printed on Aug. 28, 2012.

European Patent Office Espacenet, English abstract of EP0554864 (A1), printed on Aug. 28, 2012.

European Patent Office, extended European search report for EPO application No. 17182586.2-1614, dated Dec. 7, 2017, pp. 1-8.

Intellectual Property Corporation of Malaysia, Substantive Examination Adverse Report for Malaysian application No. PI 2013004272, dated Oct. 13, 2017, pp. 1-3.

State Intellectual Property Office of People's Republic of China, Application No. 201510520132.1, Second Office Action, dated Aug. 22, 2017.

* cited by examiner

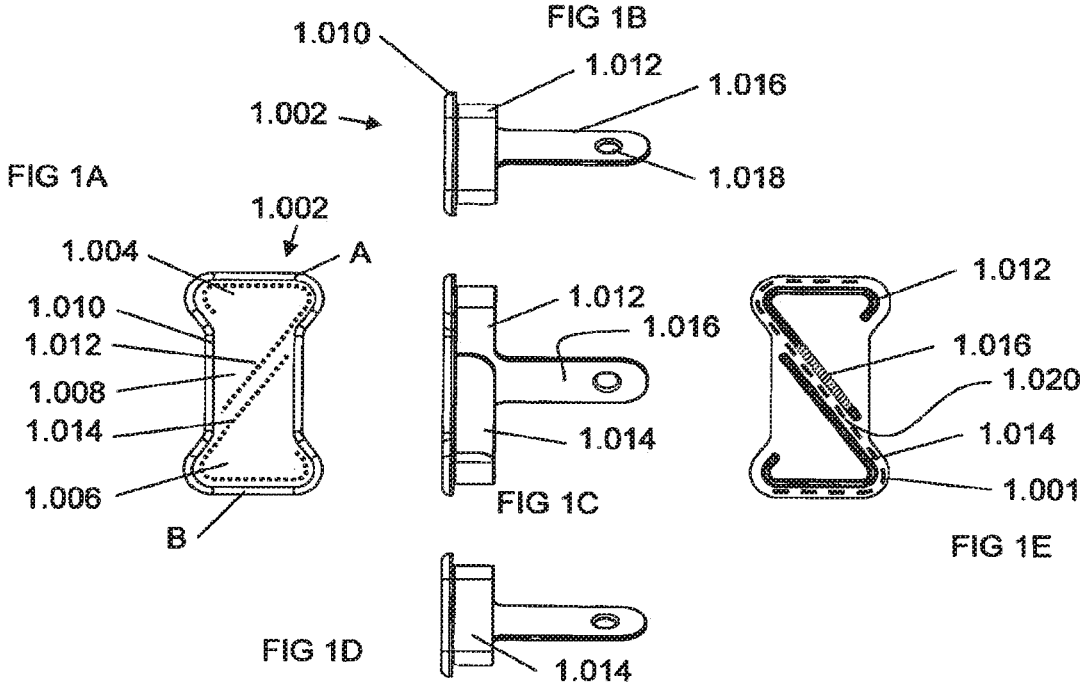
FIG 1B
1.010
1.012
1.016
1.002
1.018
FIG 1A
1.002
1.004
A
1.010
1.012
1.008
1.014
1.006
B
1.012
1.016
1.014
FIG 1C
1.012
1.016
1.020
1.014
1.001
FIG 1E
FIG 1D
1.014
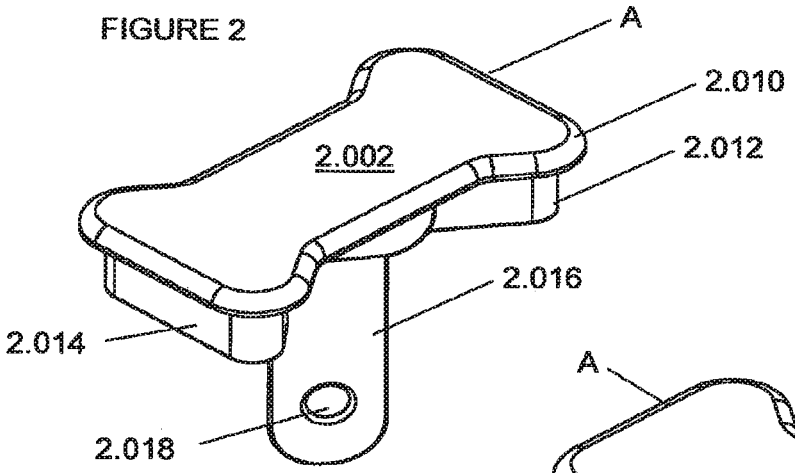
FIGURE 2
A
2.010
2.002
2.012
2.016
2.014
2.018
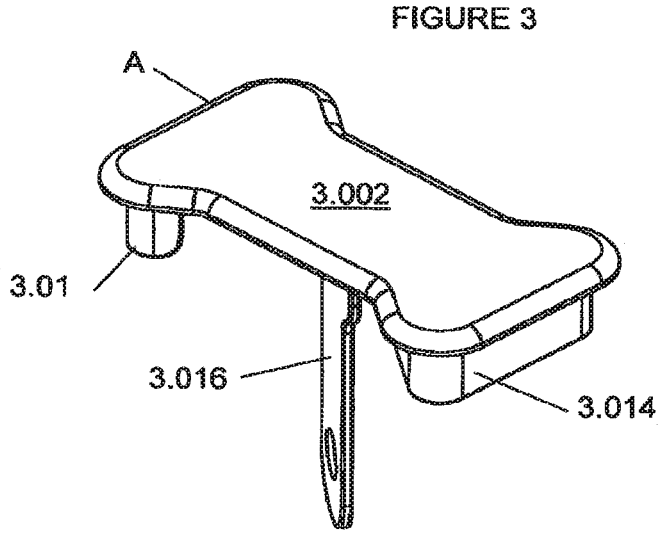
FIGURE 3
A
3.002
3.01
3.016
3.014

FIGURE 4
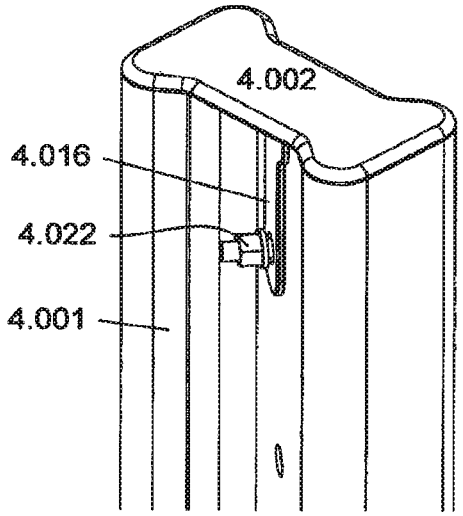
FIGURE 5
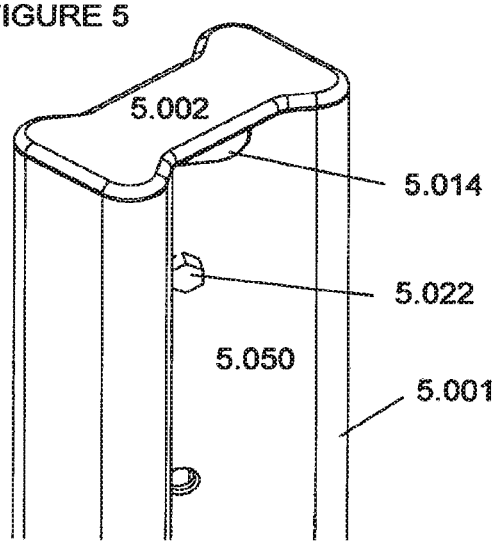
FIG 6A
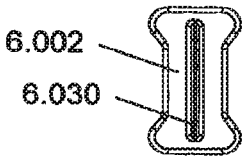
FIG 6B
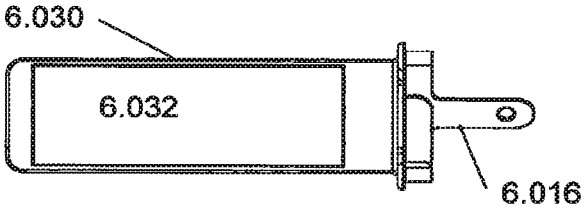
FIG 6D
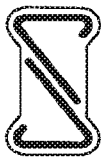
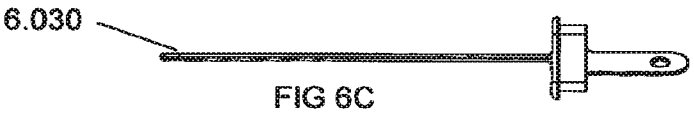
FIG 6C
FIGURE 7
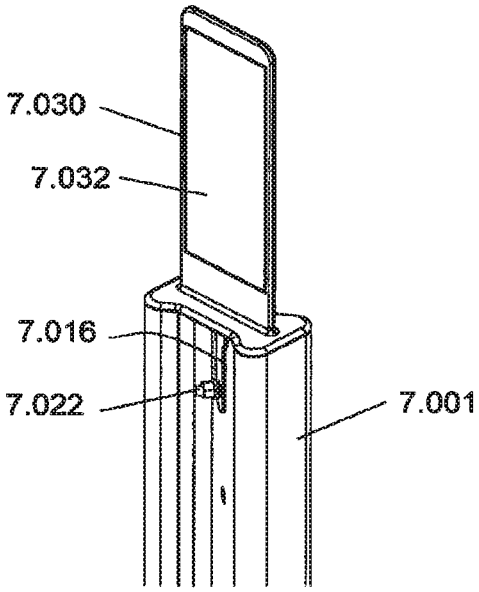

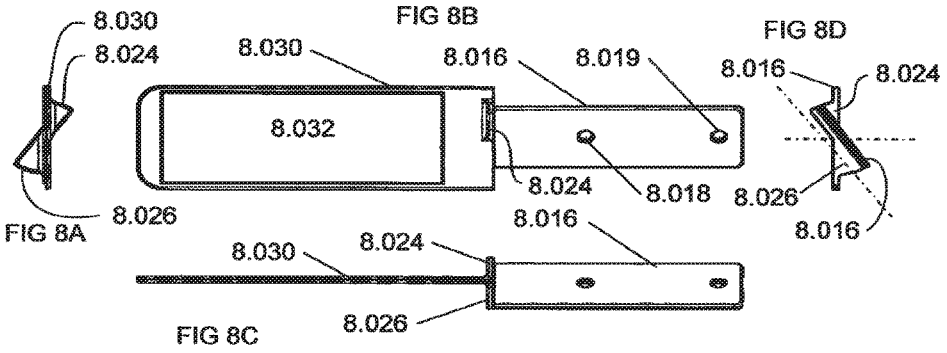
FIGURE 9
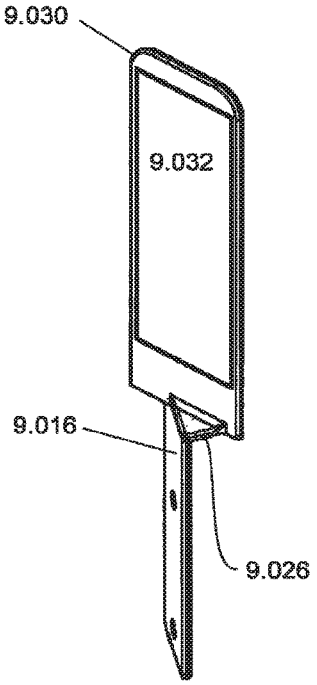
FIGURE 10
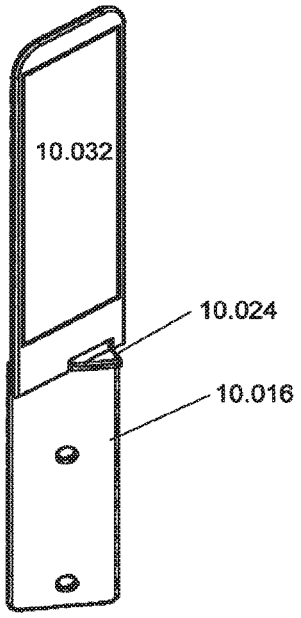

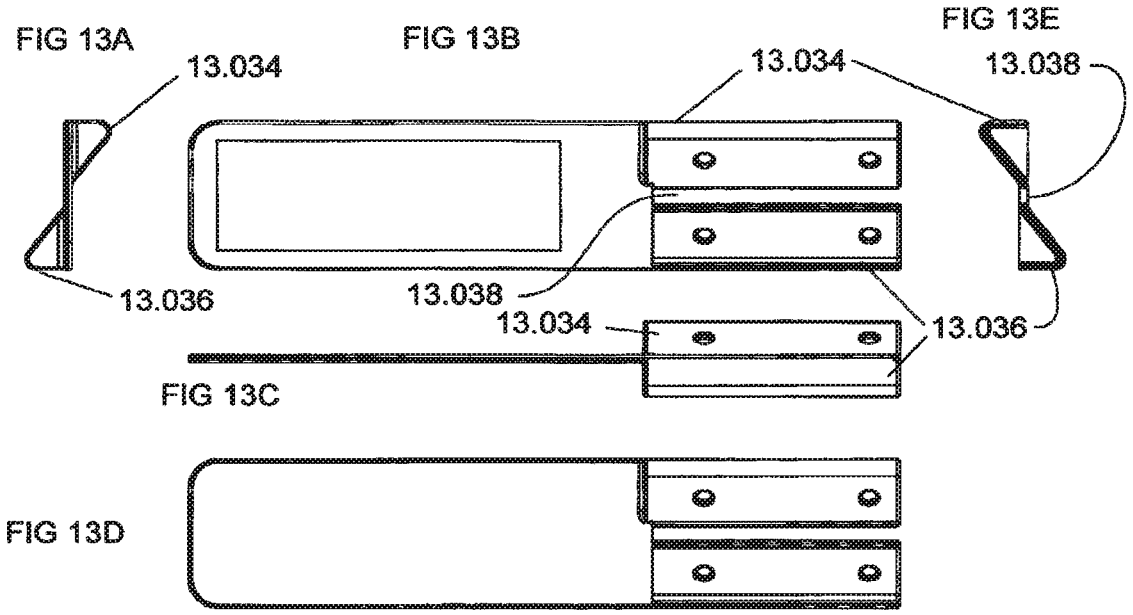
FIG 13A
13.034
13.036
FIG 13B
13.034
13.038
13.034
FIG 13E
13.038
13.036
FIG 13C
FIG 13D
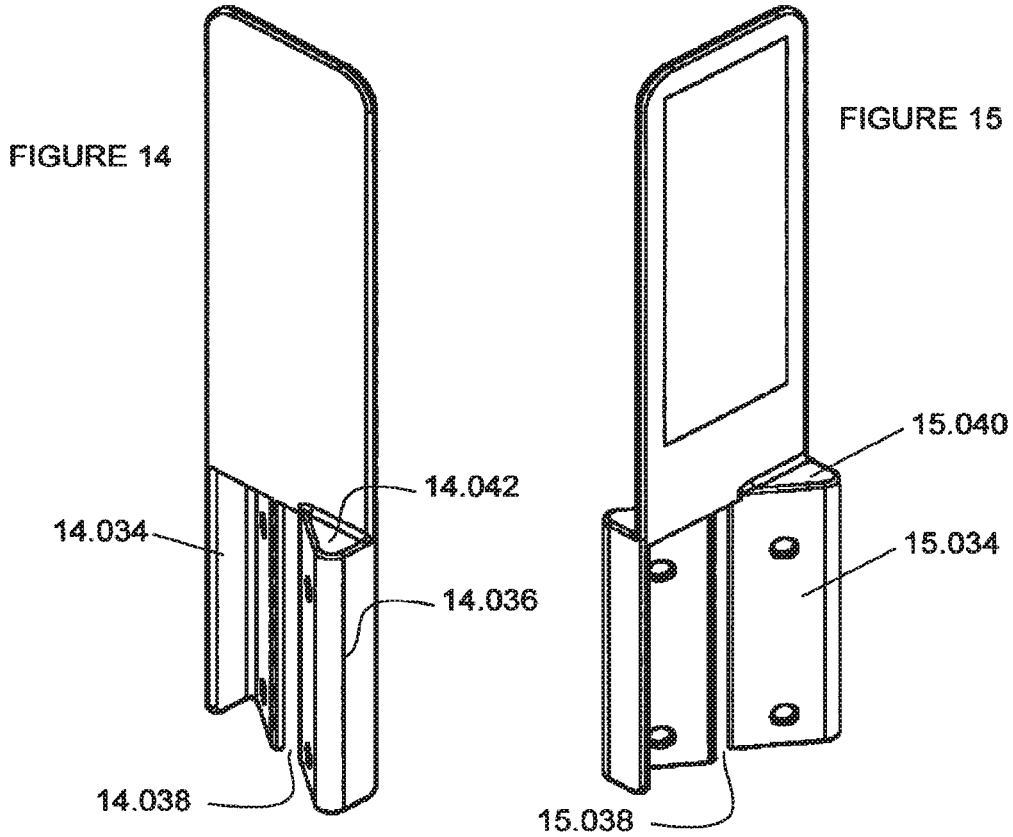
FIGURE 14
14.042
14.034
14.036
14.038
FIGURE 15
15.040
15.034
15.038

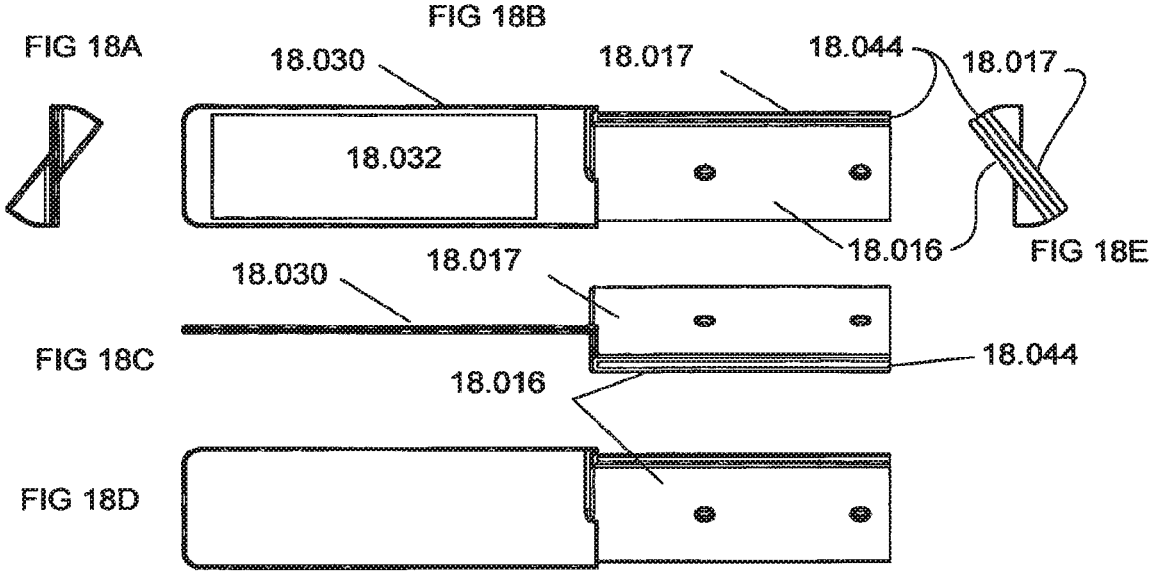
FIG 18A
FIG 18B
18.030
18.017
18.044
18.017
18.032
18.016
FIG 18E
18.030
18.017
FIG 18C
18.044
18.016
FIG 18D
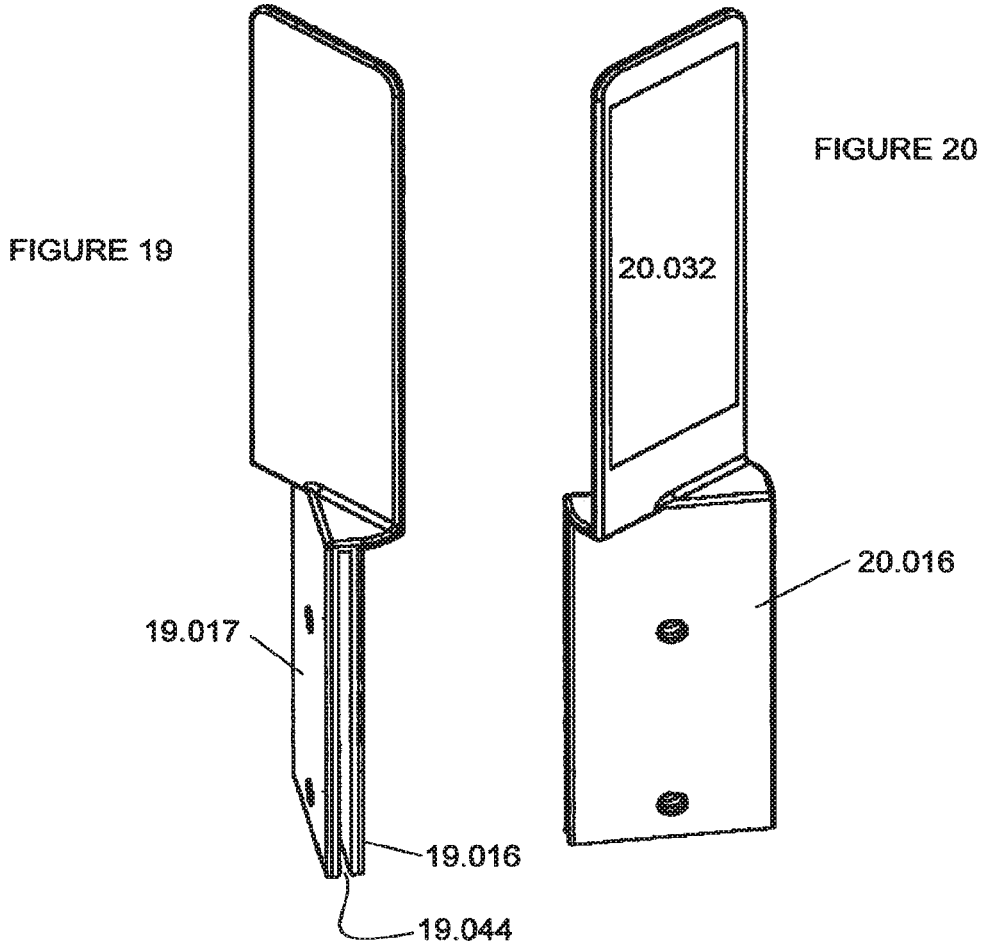
FIGURE 19
FIGURE 20
20.032
20.016
19.017
19.016
19.044

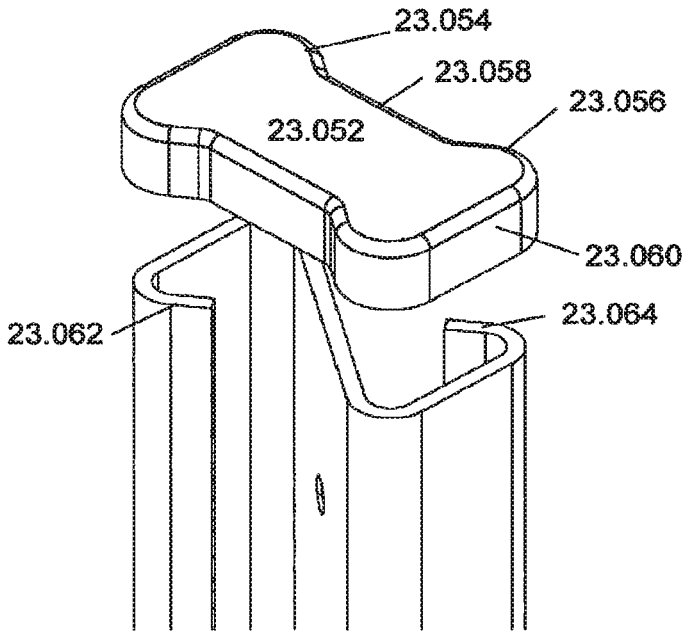
FIGURE 23
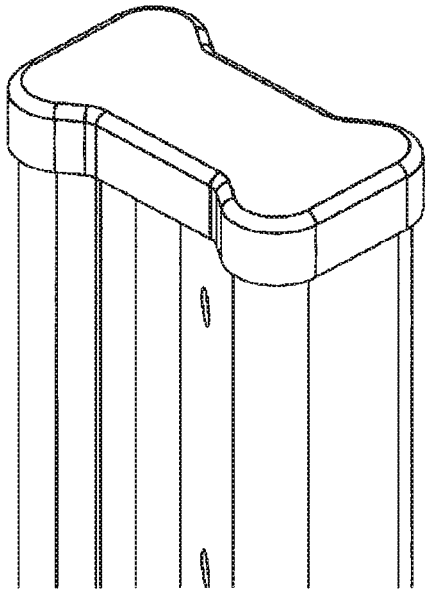
FIGURE 24
FIGURE 25
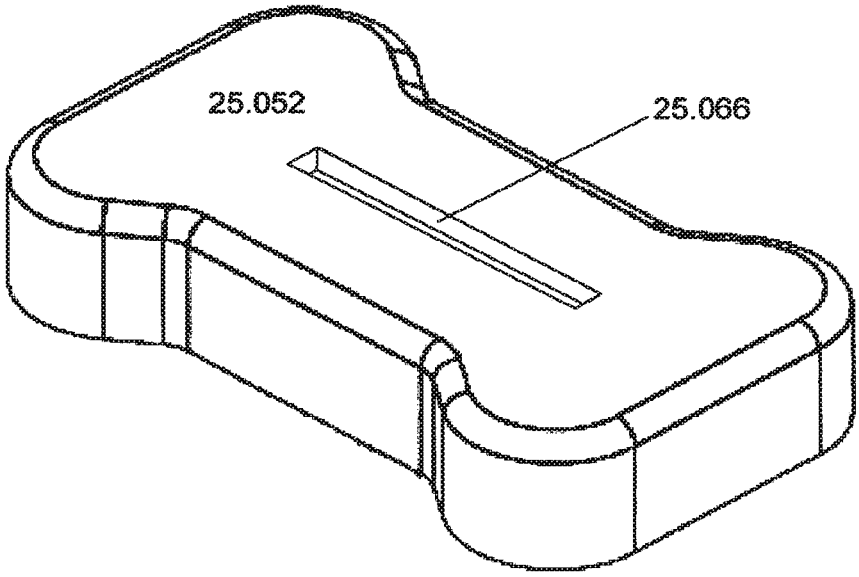

BARRIER CONSTRUCTION

This application is a divisional patent application of U.S. patent application Ser. No. 16/400,748, filed on May 1, 2019, which is a divisional application of U.S. patent application Ser. No. 15/490,537, filed on Apr. 18, 2017 and now U.S. Pat. No. 10,329,722, which is a divisional patent application of U.S. patent application Ser. No. 14/122,952, filed on Mar. 17, 2014 and now U.S. Pat. No. 9,631,331, which is the National Stage Entry of International Application No. PCT/AU2010/000544, filed on May 16, 2012, which claims the benefit of Australian Application No. 2011902086 filed May 30, 2011, which are hereby incorporated by reference. The International Application No. PCT/AU2012/000544 was published on Dec. 6, 2012.

I. FIELD OF THE INVENTION

This invention relates to an improved barrier construction, such as for roadway, guard rail, or safety barrier including a roadside post attachment, a post, a method of making the post, assembling of the barrier, a post cap and post delineators suitable for use with "Z" section posts.

II. BACKGROUND OF THE INVENTION

The construction of a roadway barrier, important in providing roadway safety, has been the subject of development for many years. Improvements in roadway barrier constructions which provide better safety, or better control of the barrier's performance, are desirable.

III. SUMMARY OF THE INVENTION

The present invention provides a roadway, guard rail or safety barrier having a post and beam construction wherein the beam is mounted to the post by means of a carriage, the beam being secured to the carriage by a securement means, the carriage being adapted to travel longitudinally relative to the post in the event of a collision, the post further including at least one carriage support means, and one or more engagement means on an outer face of the post, the engagement means being adapted to be engaged by the securement means to provide resistance to movement of the carriage with respect to the post, wherein the carriage is sized and shaped so as to not engage or to minimize engagement with the engagement means during the movement.

The one or more engagement means can each comprise one or more projections which extend from or are proud of an outer face or portion of the post.

The engagement means can be of a shape which is one of the following: a crescent shape; a cuneiform shape; a chevron shape; a boomerang shape; a part circular shape; a part elliptical shape; a part square shape; a part rectangular shape, a triangular shape.

The one or more engagement means can be formed by a portion of the post being moved through an outer surface of the post so as to plastically deform the portion, without completely separating the portion from the outer surface.

The engagement means can be formed by deforming a strip of predetermined width, the width being measured in the direction of travel of the carriage relative to the post, from the post outwardly so that plastic deformation of the strip occurs, wherein the strip is not deformed beyond the tensile strength of the material that the post is made of.

The engagement means can be a section of the post which extends from or is proud of an outer face of the post and has two ends which remain connected to the post and central section which is proud of the outer face of the post.

The post can include a plurality of engagement means located along a longitudinal axis of the outer surface of the post.

The width of the at least one engagement means, as measured in the direction of travel of the carriage relative to the post, determines the force at which the engagement means will fracture or shear when engaged by the securement means during movement of the carriage relative to the post.

The post can have a plurality of the engagement means, and each of the engagement means have one or more of the following features: are of the same width, as measured in the direction of travel of the carriage relative to the post; have widths that are of different magnitudes; have widths of different magnitudes, such that the magnitude of the width of successive engagement means increases in the direction of travel of the carriage with respect to the post; include a pin that is received by a through aperture in the post, for obstructing travel of the carriage with respect to the post; include a pin that is received by a through aperture in the post, for obstructing travel of the carriage with respect to the post, the pin having a weakened neck portion which engages an inner surface of the carriage.

The securement means can be a bolt which engages a thread on the carriage means and when the bolt secures the beam to the carriage, with the carriage mounted on the post, an end of the bolt will be at or near to an outer surface of the post, so as to engage the at least one engagement means after the carriage moves with respect to the post.

The assembly of the securement means to assemble the post, carriage and beam, can prevent the carriage and thus the beam from being lifted off the post prior to a collision.

The securement means is adapted to engage at least one of the one or more engagement means during a collision.

The carriage has a formation or recess which will allow the carriage to travel over or past the engagement means, but which will not allow the carriage pass the carriage support means.

The carriage support means is one or more of the following: a cantilevered tab which is formed by bending and shearing a portion of the post; attached to the post along a horizontal attachment edge; attached to the post along a longitudinal attachment edge; a separate component attached to the post so that a portion thereof is in the path of the carriage.

The one or more engagement means each including one or more projections which extend from or are proud of an outer face of the post, wherein each projection is formed by a portion of the post protruding through the outer face.

The portion can be connected at opposed ends to the post, and is plastically deformed without separating the portion from the outer face.

The present invention also provides a post for a roadway, guard rail or safety barrier as described above, wherein one or more the projections is of one of the following: a crescent shape; a cuneiform shape; a chevron shape; a boomerang shape; a part circular shape; a part elliptical shape; a part square shape; a part rectangular shape, a triangular shape.

Each of the one or more engagement means is one or more of the following: formed by stretching a strip of predetermined width, the width being measured in a direction along a longitudinal axis of the post, so that a plastic deformation of the strip occurs; formed by stretching a strip of predetermined width, the width being measured in a direction along a longitudinal axis of the post, so that a plastic deformation of the strip occurs, the strip is stretched within the tensile strength of the material of the post; has two ends which remain connected to the post, and a central section which is proud of the outer face of the post; has two ends which remain connected to the post, and a central section which is proud of the outer face of the post, the ends being located toward a longitudinal axis of the post and the central section being located away from the longitudinal axis of the post.

The outer face of the post can have at least one through aperture for receiving one of the following: a pin; a pin with a weakened neck portion at the end of the pin that is located away from the post.

The post can be one of the following shapes: a Z post; I-post, C-post, a Charlie post, a rectangular post, an H post, U post an O-post.

The present invention also provides a method for forming a post as described above, including steps of feeding a sheet metal blank through one or more rolls to form the post, cutting or slitting portions of the post and deforming the portions to form the engagement means.

The method can include the steps of cutting or slitting portions from a blank, the cut or slit portions being located to correspond to the engagement means, deforming the cut portions to form the engagement means, and then feeding the blank through one or more rolls to form the post, the rolls keeping clear of the engagement means during roll forming the post.

The present invention further provides a carriage for use with a roadway, guard rail or safety barrier system which has a beam and post construction, the carriage being adapted to support the beam and mount the beam to the post, the carriage having an inner face which in use faces an outer face of the post, the carriage including a securement receiving means for securing the beam to the carriage, wherein the carriage is sized and shaped so that in use it will not engage or will minimize engagement with formations on the post.

The inner face can include a recess, groove or channel adapted to in use avoid contacting formations on the post which hinder sliding movement of the carriage along the post.

The recess, groove or channel can have a longitudinal axis generally parallel to a longitudinal axis of the post.

The recess, groove or channel can be one of the following: extends through a full height of the carriage, as measured in the longitudinal direction of a sliding movement of the carriage; extends through a portion of the height of the carriage, as measured in the longitudinal direction of a sliding movement of the carriage.

The securement receiving means can include one or more of the following: one or more threaded holes, and in use the threaded hole receives a bolt for securing the beam to the carriage; one or more threaded holes extending from an outer face of the carriage and opens into the recess; one or more threaded holes provided through a flange which extends from a main body of the carriage.

The carriage can include one of the following: a middle section flanked on each side by a free end, wherein the attachment means is provided in the middle section; a middle section flanked on each side by a free end, wherein the attachment means is provided in the middle section, wherein the free ends are shaped and sized to in use guide a sliding movement of the carriage along the post; a middle section flanked on each side by a free end, wherein the attachment means is provided in the middle section, wherein one of the free ends terminates in a hook or bearer portion which extends toward an inner surface of the middle section; a middle section flanked on each side by a free end, wherein the attachment means is provided in the middle section, wherein the inner surface carries one or more bearing pads, wherein in use a front face of the post is adapted to fit between the hook and the at least one bearing pad.

The present invention further provides a carriage for use with a roadway, guard rail or safety barrier system which has a beam and post construction, the carriage being adapted to support the beam and mount same to the post, the carriage having an inner face which in use faces the post, the carriage including a post attachment portion having a first aperture for receiving a securement means to attach the carriage to the post, and a beam attachment portion having a second aperture for receiving a second securement means to attach the beam to the carriage.

The first aperture can be elongated, wherein in use a longitudinal axis of the first aperture is parallel to a longitudinal axis of the post.

The post attachment portion can lie against an outer surface of the post, and the beam attachment portion is located away from the outer surface of the post.

The carriage can further include an intermediate portion interconnecting the post attachment portion and the beam attachment portion.

The beam attachment portion can be located above the post attachment portion.

The present invention further provides a post attachment arrangement having an attachment tab adapted for attachment to a segment of a Z post, and a transverse segment to which the tab is affixed.

The present invention further provides a delineator attachment arrangement for a Z post including a tab adapted for attachment to an oblique segment of a Z post, and wherein the transverse segment is an end engagement segment adapted to engage a section of the end of a Z post.

The end engagement segment can be one or more of the following: transverse to the tab; includes a substantially planar flange; in the form of a pair of triangular segments; the plane of the engagement segment is transverse to the plane of the tab; a cap.

The tab can be one of more of the following: conforms to a portion of a Z post cross-section; a substantially planar element; includes one or more attachment apertures; attached to an exterior edge of one of the triangular segments; skewed in relation to the delineator; the plane of the tab (the tab plane) and the plane of the delineator are skewed about a common axis.

The arrangement can include one of the following: a pair of attachment tabs; a pair of attachment tabs wherein each attachment tab has a mutually parallel segment; a pair of tabs that define a slot adapted to receive a portion of the oblique segment of a Z post therein.

The present invention also provides a cap for a Z post including at least one engagement tab adapted to engage at least a portion of the cross-section of a Z post.

The cap can include one or more of the following: a pair of attachment tabs forming a channel on the underside of the cap, the channel being adapted to receive a portion of a Z post; a downward extending skirt adapted to engage with the outer side of a portion of a Z-post; a slot through which a delineator can pass; a slot through which a delineator can pass wherein, in use, the slot is oriented to present the longitudinal sides of the slot to oncoming traffic.

The present invention also provides a delineator for a Z-post, including a pair of opposite faces and a post attachment arrangement including at least one transverse member and one depending member, the delineator including at least one snap-fit projections on one of the opposed sides, and adapted to engage with a slot of a cap as described in the preceding paragraphs. It can include a pair of snap-fit projections, one on each opposed side of the delineator.

The present invention further provides a method of constructing a roadway, guard rail or safety barrier having a post and beam construction, including the steps of: placing a carriage onto the post, the carriage being supported by one or more projections on the post which are located at a desired height for the beam; inserting the post into the ground at a desired position to an appropriate depth; securing the beam onto the carriage.

The present invention also provides a method of constructing a roadway, guard rail or safety barrier having a post and beam construction, including the steps of: inserting the post into the ground at a desired position to an appropriate depth; securing the beam onto a carriage; placing the beam and carriage onto the post, the carriage being supported by one or more projections on the post which are located at a desired height for the beam.

The present invention further provides a method of constructing a roadway, guard rail or safety barrier having a post and beam construction, including the steps of: securing the beam onto a carriage; positing the beam and carriage with respect to the ground at a desired location, and so that the beam is located at a height appropriate for acting as a barrier; driving the post past the carriage and into the ground, until a projection on the post passes the carriage such that the carriage is supported by the projection, and until the post is driven into the ground at an appropriate depth.

The present invention also provides a method of constructing a roadway, guard rail or safety barrier having a post and beam construction, including the steps of: inserting the post into the ground at a desired position to an appropriate depth; placing a carriage onto the post, the carriage being supported by one or more projections on the post which are located at a desired height for the beam; securing the beam onto the carriage.

The above described methods of constructing a roadway can further include the steps of removing the carriage and the beam from the post, and replacing the carriage and the beam on the post at a location higher than the original location for the carriage.

IV. BRIEF DESCRIPTION OF THE DRAWINGS

An embodiment or embodiments of the present invention will now be described, by way of example only, with reference to the accompanying drawings, in which:

FIG. 1A shows a top view of a post cap;

FIG. 1B shows an end view A of the cap of FIG. 1A;

FIG. 1C shows a side view of the cap of FIG. 1A;

FIG. 1D shows an end view B of the cap of FIG. 1A;

FIG. 1E shows an underside view of the cap of FIG. 1A;

FIG. 2 shows a first perspective view of the cap of FIG. 1A;

FIG. 3 shows a second perspective view of the cap of FIG. 1A;

FIG. 4 shows a cap attached to a Z post;

FIG. 5 is a second view of the cap attached to a post;

FIG. 6A shows a top, view of another delineator attachment arrangement;

FIG. 6B shows a side view of the arrangement of FIG. 6A;

FIG. 6C shows an edge view of the arrangement of FIG. 6A;

FIG. 6D shows a bottom view of the arrangement of FIG. 6A;

FIG. 7 illustrates the delineator arrangement of FIG. 6 attached to a Z post;

FIG. 8A illustrates a top view of a further delineator attachment arrangement;

FIG. 8B shows a side view of the arrangement of FIG. 8A;

FIG. 8C shows an edge view of the arrangement of FIG. 8A;

FIG. 8D shows an underside view of the arrangement of FIG. 8A;

FIG. 9 is a perspective view of the delineator arrangement of FIG. 8;

FIG. 10 is a second perspective view of the delineator arrangement of FIG. 8.

FIG. 13A illustrates a first end view of another delineator arrangement;

FIG. 13B illustrates a side view of the delineator of FIG. 13A;

FIG. 13C illustrates an edge view of the delineator of FIG. 13A;

FIG. 13D illustrates a second side view of the delineator of FIG. 13A;

FIG. 13E illustrates a second end view of the delineator of FIG. 13A;

FIG. 14 illustrates a first perspective side view of the delineator of FIG. 13;

FIG. 15 illustrates a second perspective side view of the delineator of FIG. 13;

FIG. 18A illustrates a first end view of a further delineator arrangement;

FIG. 18B illustrates a first side view of a delineator arrangement of FIG. 18A;

FIG. 18C illustrates an edge view of a delineator arrangement of FIG. 18A;

FIG. 18D illustrates a second side view of a delineator arrangement of FIG. 18A;

FIG. 18E illustrates a second end view of the delineator arrangement of FIG. 18A;

FIG. 19 is a perspective side view of the delineator of FIG. 18D;

FIG. 20 is a perspective side view of the delineator of FIG. 18B;

FIG. 23 shows an exploded view of a post cap arrangement;

FIG. 24 shows the assembled view of the arrangement of FIG. 23;

FIG. 25 shows a modified cap similar to that of FIG. 23.

Figure 11:
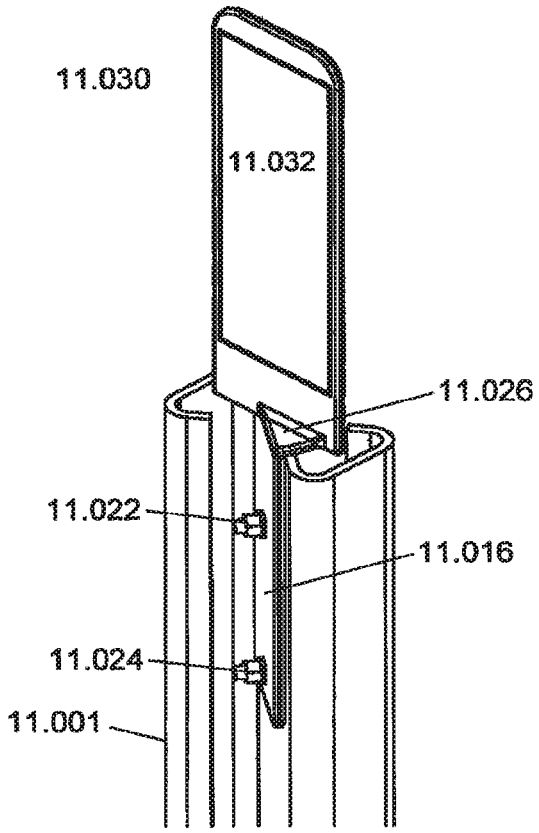
FIG. 11 shows a first view of the delineator arrangement attached to a Z post

The numbering convention used in the drawings is that the digits in front of the full stop indicate the drawing number, and the digits after the full stop are the element reference numbers. Where possible, the same element reference number is used in different drawings to indicate corresponding elements.

It is understood that, unless indicated otherwise, the drawings are intended to be illustrative rather than exact representations, and are not necessarily drawn to scale. The orientation of the drawings is chosen to illustrate the features of the objects shown, and does not necessarily represent the orientation of the objects in use.

V. DETAILED DESCRIPTION OF THE EMBODIMENT OR EMBODIMENTS

A. Post—Engagement Means, Support Means

Illustrated in FIGS. 30 to 48 are features of components and assemblies which form a roadway, guard rail, or safety barrier. While the following description and drawings illustrate a Z-post as described in co-pending application, PCT/AU2010/000321 (WO 2010/105307), which is incorporated in its entirety by reference, it will be readily understood the post shape is not limited to a Z-post except where the claims specifically identify a Z-post.

Figure 30:
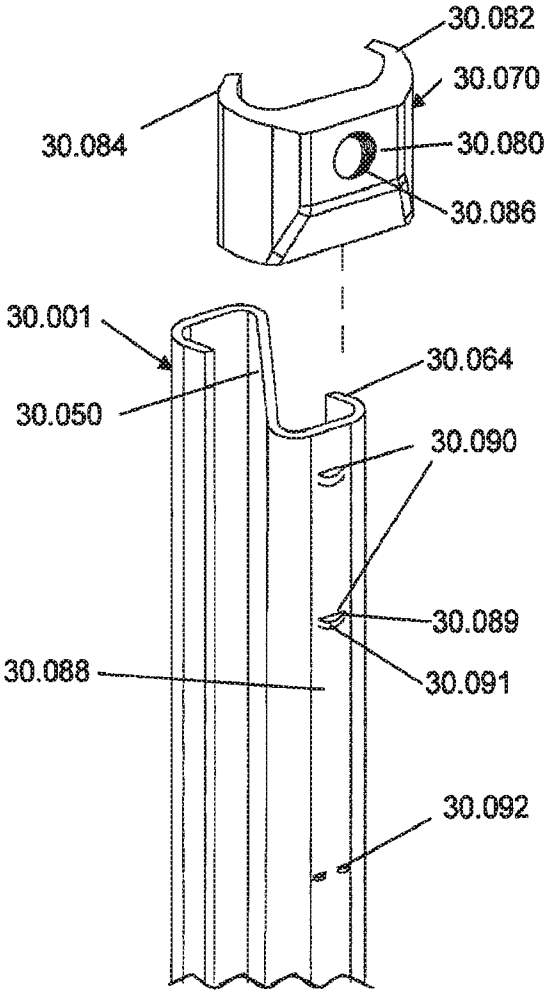
FIG. 30 is an exploded perspective view of a carriage and a Z-post.
Figure 33:
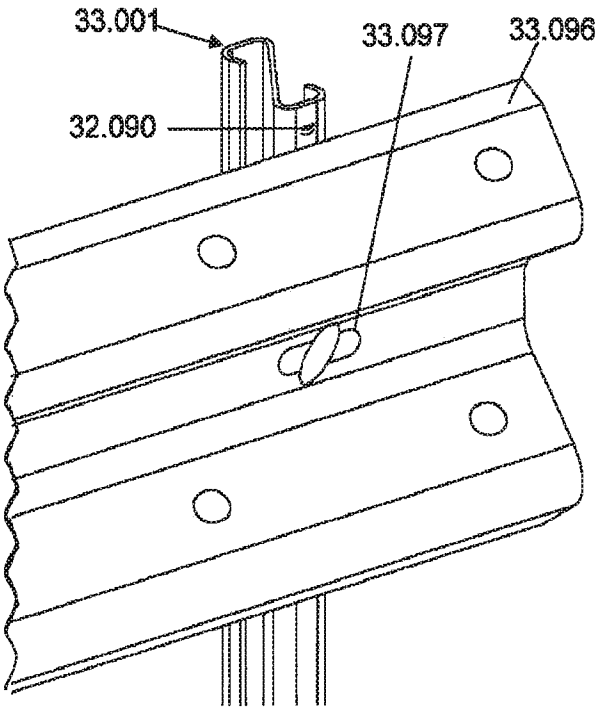
FIG. 33 shows the assembled barrier of FIG. 32.

FIG. 30 illustrates a carriage 30.070 and a Z-post 30.001 which are part of a roadside barrier, guard rail or safety barrier arrangement. The carriage 30.070 is sized and shaped, and adapted to slide or move longitudinally along the Z post 30.001. For more details of this, reference is made to co-pending application PCT/AU2010/000321 (WO2010105307).

Figure 31:
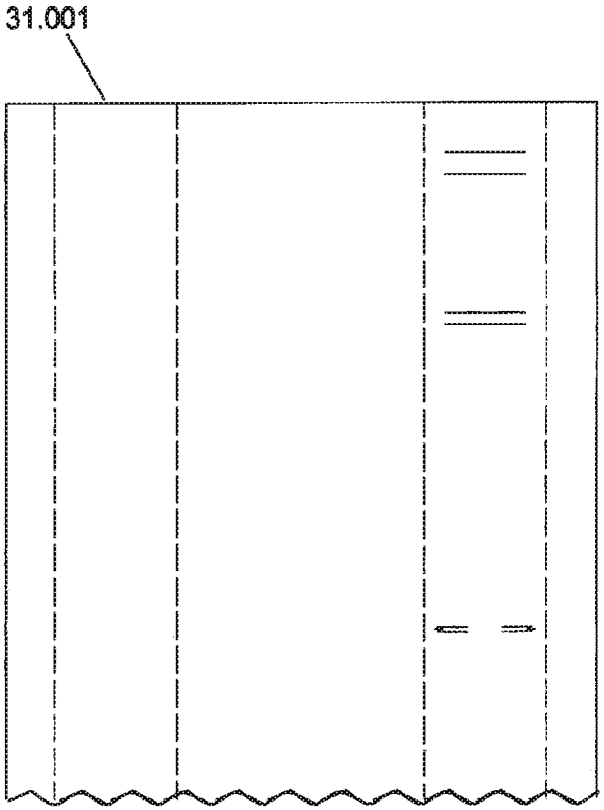
FIG. 31 is partial front view of a sheet material prior to forming the Z-post of FIG. 30.
Figure 63:
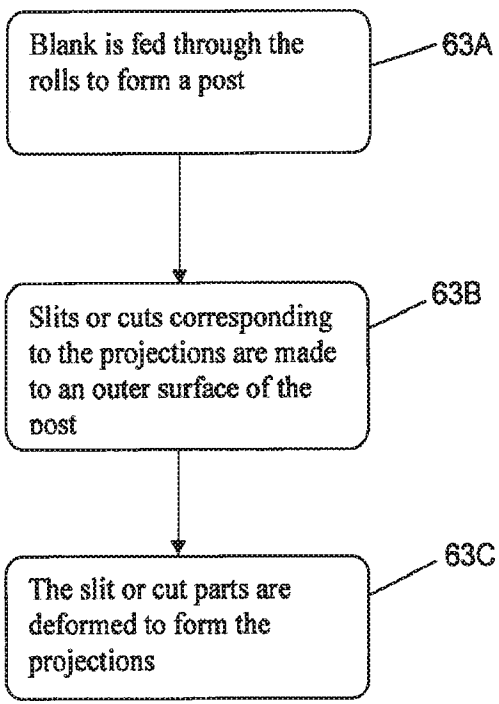
FIG. 63 is a flow chart depicting another method for manufacturing a post.
Figure 62:
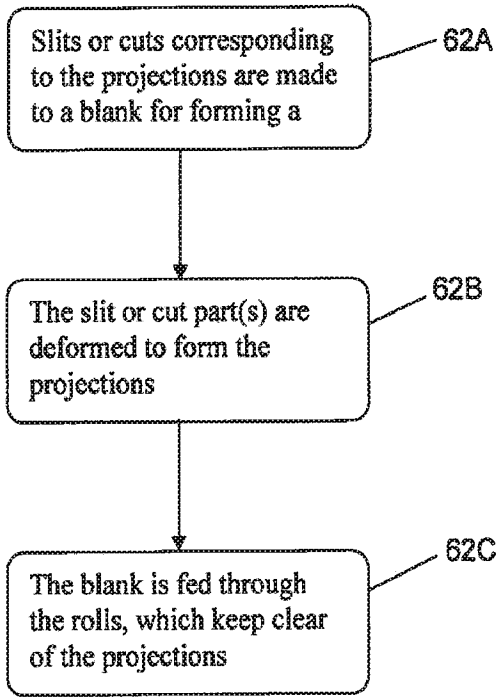
FIG. 62 is a flow chart depicting a method for manufacturing a post.

The Z-post can be constructed from a sheet material such as the one depicted in FIG. 31. This can be done by, for example roll forming. FIGS. 62 and 63 depict two methods for roll forming the post. As shown in FIG. 62, projections can be punched, or laser cut in step 62A, and pressed out from the blank for the post until the desired deformation has been achieved (step 62B). The blank can then be fed through one or more rolls to form the post in step 62C. The rolls can keep clear of the projections if they are formed before rolling. Alternatively as illustrated in FIG. 63, the projections can be cut from a blank, or preformed by slits or cuts made to the blank in step 63A, before it is rolled to form a post in step 63B. The slits or cuts are located to correspond to the desired locations of the projections. The slit or cut portions are then deformed, e.g. punched out, in step 63C after the blank has been fed through the rolls and the post is roll into a Z post form.

Figure 48:
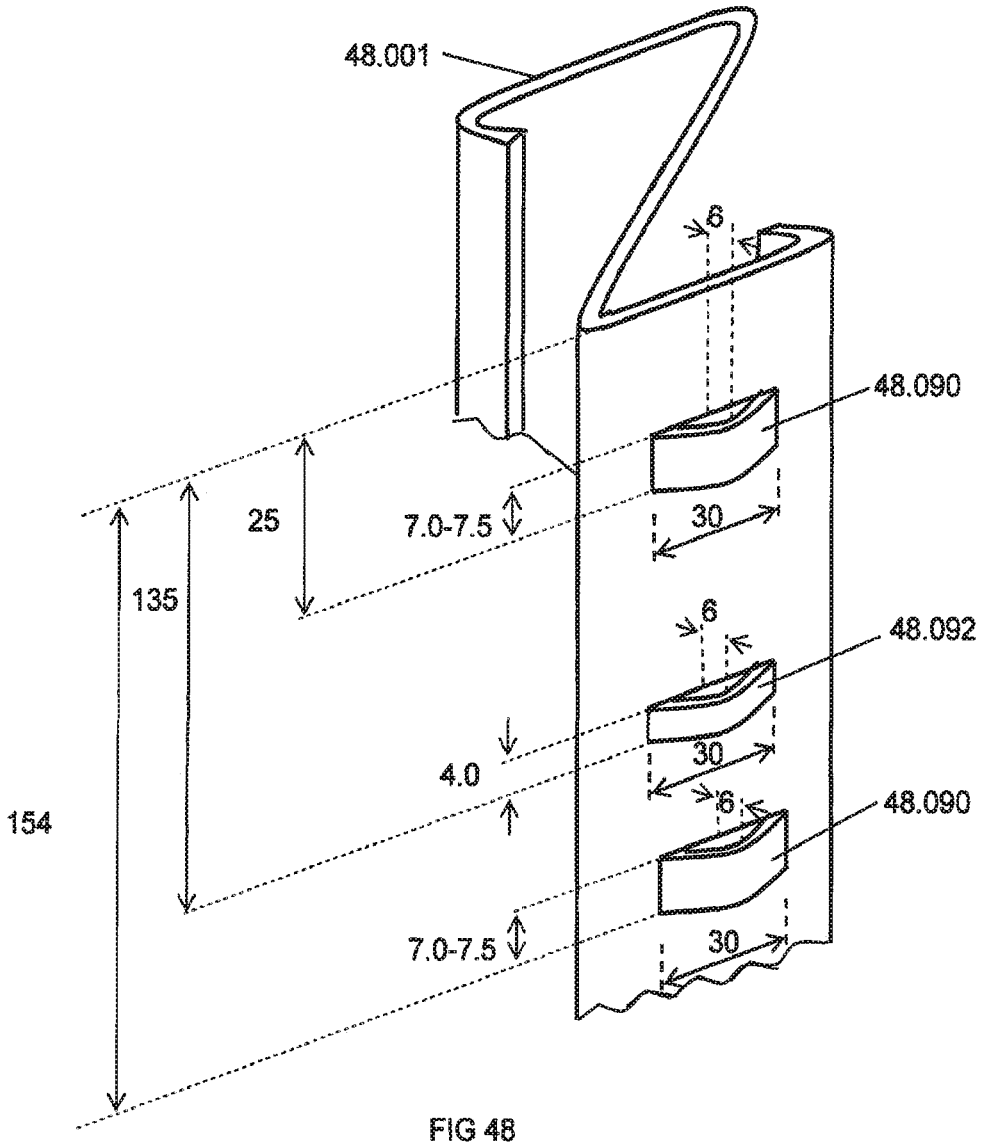
FIG. 48 is a perspective view of another Z post.

The front or outer face 30.088 of the Z post 30.001 is provided with one or more engagement means 30.090 located along a longitudinal axis of the outer surface of the post 30.001, as illustrated also in FIG. 48. The engagement means 30.090 are sized and shaped to restrict the movement of a bolt located in the carriage 30.070 and thus the carriage 30.070 along the Z post 30 in the event of a collision. The engagement means 30.090 are provided toward the top of the post 30.001. As will be explained later the carriage 30.070 is configured so that as the carriage 30.070 travels relative to the post 30.001, there is no or minimal engagement between the carriage and the engagement means. It is the attachment means that engages the engagement means and obstructs the travel of the carriage on the post.

The engagement means 30.090 includes one or more projections which extend outwardly from the front or outer face of the post 30.001. The projections can have different configurations, as long as in use they engage the attachment means to retard or restrict the carriage movement as appropriate (as explained with reference to FIGS. 34 and 35).

The width of the projections, as measured in the direction of the travel of the carriage relative to the post, that is, in a direction parallel to a longitudinal axis of the post, determines the force at which the engagement means will deform or fail and allow the carriage to pass over the engagement means 32.090. Each engagement means provided on the same post can have projections of the same width. Alternatively the plurality of engagement means can have projections of gradually changing, e.g. increasing or decreasing widths, with projections located nearer the top of the post being wider or narrower in width. If desired the widths can be such that two are the same while one is different, whether greater or lesser. For example the engagement means 48.090 as illustrated in FIG. 48 can be of different width as measured in the longitudinal direction of the post 48.001. The width can be increasing with height so that engagement means located closer to the top of the post 48.001 are wider, thus requiring a greater force to fracture or deform than a previously engaged engagement means, in the direction of travel of carriage relative to the post.

The projections of the engagement means are connected or attached to the post 32.001, but the connections will be broken in a collision of sufficient force. The projections can have different shapes, as long as they hinder the travel of the carriage 30.070 as described in later paragraphs. For instance, the projections can have a crescent shape, a cuneiform shape, a chevron shape, a boomerang shape, a part circular shape, a part elliptical shape, a part square shape or a part rectangular shape.

The projections can be separate components attached onto the post by, e.g. welding. Alternatively they can be deformed parts from the post 30.001, such as tabs, or outwardly pressed parts of the post (e.g. see FIGS. 36 to 41), so that the pressed parts are plastically deformed, without being completely separated from the post 30.001. They can be formed from strips which are partially cut from the post and then stretched or deformed outwardly. The strip is stretched or deformed beyond the material's elastic strength so that the deformation is plastic and its stretched or deformed shape is retained after the deforming force is no longer applied. The strips can be deformed within the tensile strength of the material used for the post to prevent the strips from necking. The resulting projection, used to retard the motion of the carriage, has two ends 30.089 which remain connected to the post 30.001, and a central section 30.091 which extends outwardly from the front face 30.088 of the post.

Figure 69:
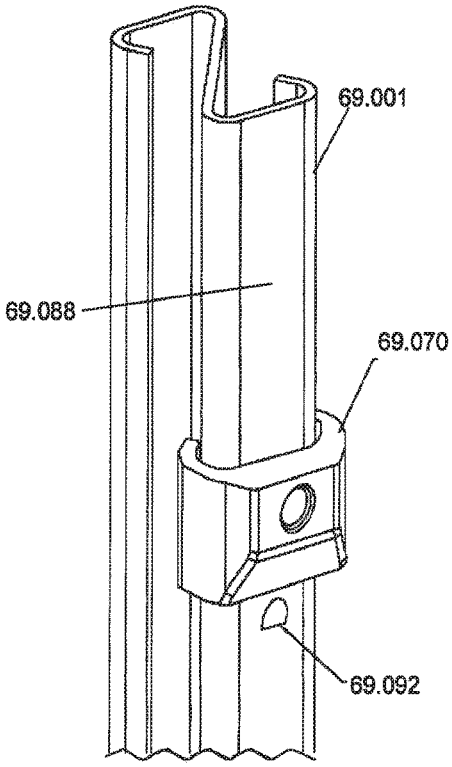
FIG. 69 is a front perspective view of a carriage and a post having a carriage support means that is a single projection.
Figure 70:
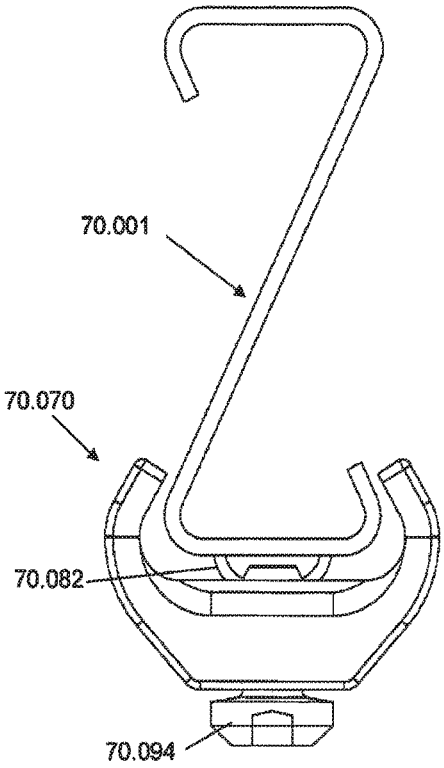
FIG. 70 is a plan view of the carriage and post in FIG. 69 and of a bolt for use with the carriage and post.

The front or outer face 32.088 of the Z post 32.001 is further provided with at least one carriage support means 30.092. The carriage is adapted to rest on the carriage support means 30.092 (e.g. see FIG. 32). The carriage support means 32.092 can be a through hole for receiving a bolt or similar that will sit proud of the outer face of the post, so as to support the carriage, or it can have one or more projections such as the projections of the engagement means. In the embodiment shown in FIG. 30 the support means 30.092 includes a pair of projections which support the bottom of the carriage 30.070 on either side of a central region of the carriage 30.070. In the embodiment shown in FIGS. 69 and 70, the support means 69.092 includes a single projection. The single projection is located on the Z post so as to support a bolt 70.094 that secures the beam (not shown) to the carriage 70.070.

B. Carriage—Attachment Receiving Means; C Cross Section

The carriage 30.070 is adapted to pass over the one or more engagement means 30.090 located centrally on the front face 30.088. The carriage 30.070 has an attachment or securement receiving means in the form of a threaded through bore 30.086, to secure the beam on to the carriage 30.070. More specific configuration of the carriage will be discussed later with reference to FIGS. 34, 35, and FIGS. 42 to 47. The attachment receiving means can receive a threaded bolt or machine screw.

The carriage 34.070 is substantially of a C cross section, having a middle section 34.080 flanked by free ends 34.082, 34.084. The middle section 34.080 has an attachment receiving means, in this case a centrally located threaded aperture 34.086 for receiving a corresponding attachment means, such as a threaded bolt or machine screw. The carriage 34.070 fits over the front or outer face 34.088 of the post 34.001, the front face 34.088 facing the road way. One free end 34.082 fits over the trailing end 34.064 of the Z post, and the opposite free end 34.084 fits over the front portion of the oblique segment 34.050 of the Z-post (see FIGS. 34 and 35). The free ends 34.082, 34.084 are shaped and sized to guide the carriage's longitudinal travel on the post, and can be differently configured depending on the type of post that the carriage is adapted to be used with, as is described in co-pending application PCT/AU2001/000321 (WO 2010/105307).

The inner surface 34.071 of the carriage 34.070, which faces the post 34.001, has a longitudinal recess 34.098 which allows the carriage 34.070 to travel over or past the centrally located engagement means, but which does not allow the carriage 34.070 to pass over the carriage support means 34.092 because they are not centrally located. The recess 34.098 can be a groove or channel provided along the inner surface 34.071. The carriage aperture 34.086 opens into the recess, groove, or channel.

FIGS. 42 to 47 depict the carriage. Details include the axially or longitudinally extending recess 44.098 and its base 47.099, and the threaded aperture 44.086. As shown here the recess can include a half-height groove 44.098 (see also for example 46.098 and 47.098) which extends through approximately half the height of the carriage 44.070. The carriage aperture 43.086 (see also e.g. 47.089) is located above the half-height groove 47.098 and displaced toward the roadside with respect of the groove 47.098. There aperture 47.098 opens into a clearance area above the half-height groove 47.098. The clearance area 47.100 is part of the recess and is configured to avoid contact with the engagement means. It will be understood that alternatively the clearance area can extend through the full height of the carriage if the inside surface 34.071 extends through the full height of the carriage. The groove is sized and shaped to avoid contact with the aforementioned engagement means 30.090 during longitudinal travel of the carriage with respect to the post.

C. Bolt

Figure 32:
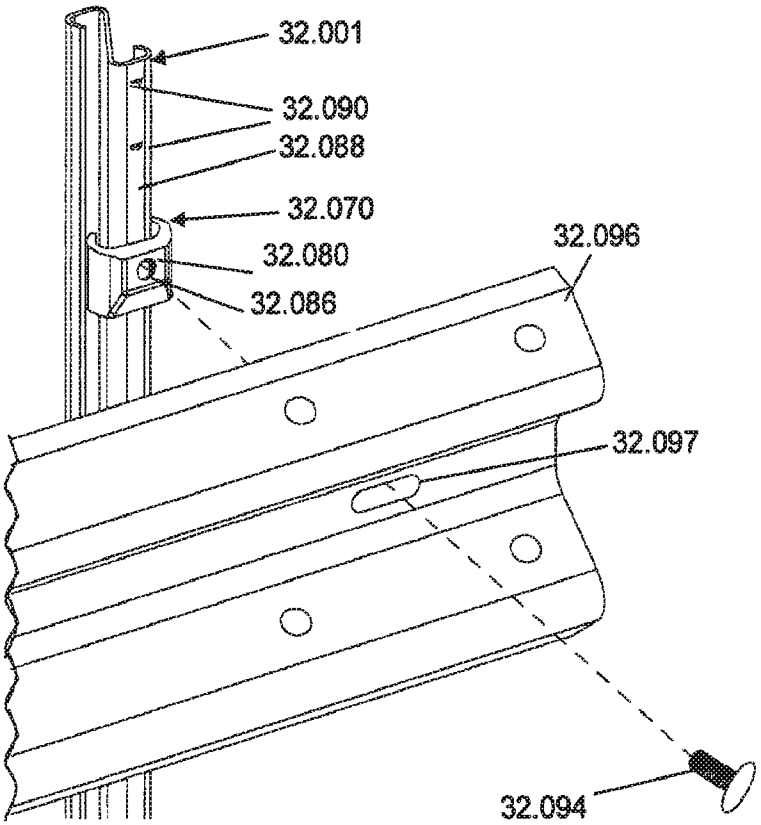
FIG. 32 is an exploded perspective view of an assembly of a roadway, guard rail, or safety barrier having a W-beam, carriage and the Z-post of FIG. 30.

As illustrated in FIG. 32, the through bore 32.086 can receive a threaded bolt 32.094 for securing the beam 32.096 to the carriage 32.070. Together, the post 32.001, carriage 32.070, and beam 32.096 form a barrier. The beam 32.096 has a through hole 32.097 which in use aligns with carriage threaded hole 32.086 and which is dimensioned to receive the bolt 32.094, but not of a size which will allow the head of the bolt to pass. The height of the beam 32.096 with respect to the post 32.001, and thus the ground, is determined by the position of the carriage 32.070 on the post 32.001. The distal end of the shank of the bolt protrudes through the carriage 32.070, so that when the carriage 32.070 is moved with respect to the post 32.001 (e.g. during collision), the bolt can engage the engagement means 32.090. However, the shank of the bolt preferably does not reach the front face 30.088 of the post 30.011, so that the movement of the carriage 32.070 in relation to the post 32.001 is not, at least initially, affected by any friction between the bolt 32.094 and the post 32.001.

Figure 78:
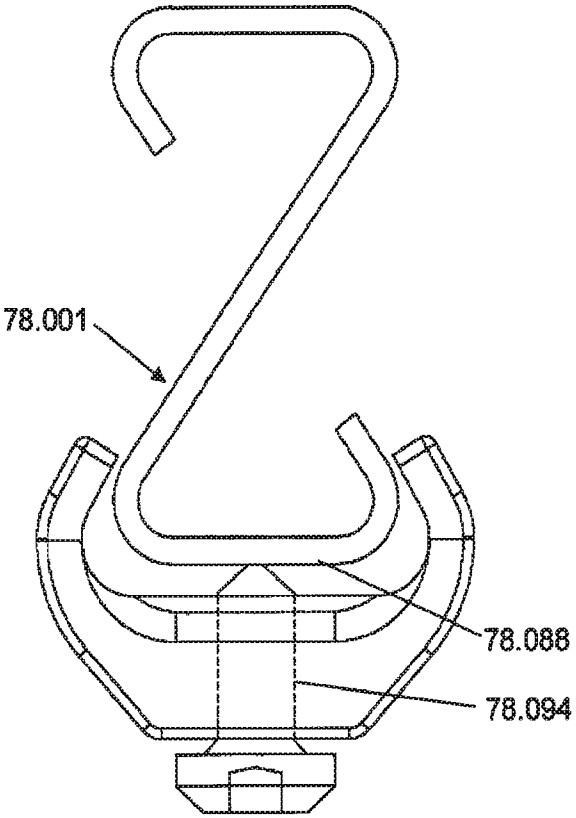
FIG. 78 is a plan view of the carriage and post in FIG. 77 and of a bolt for use with the carriage and post.
Figure 77:
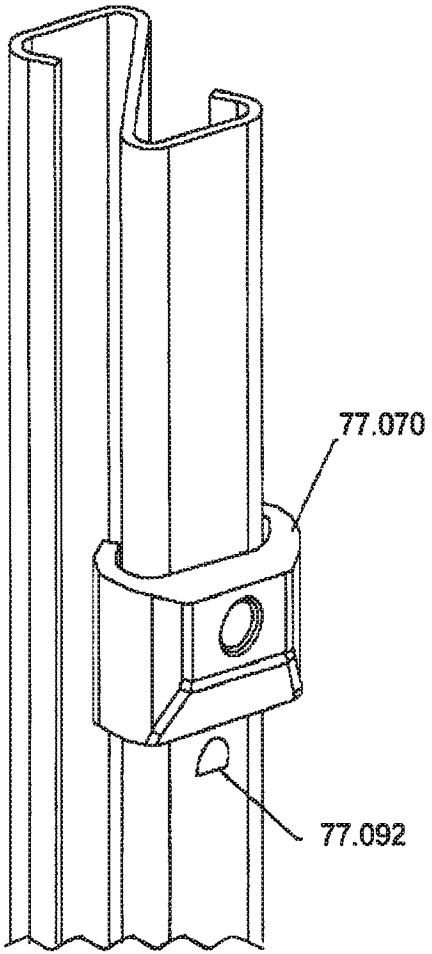
FIG. 77 is a front perspective view of another carriage and post combination.

A grub screw can be used instead of a bolt. As shown in FIGS. 77 and 78, the shank of the grub screw 78.094 can alternatively reach the front or outer face 78.088 of the post 78.001, so that the movement of the carriage 78.070 with respect to the post 78.001 is retarded by the friction between the post 78.001 and the grub screw 78.094. It may be that in this embodiment the post 77.001 does not have any other engagement means to retard the movement of the carriage 77.070.

D. Assembly—Carriage and Z Post Assembly

Figure 35:
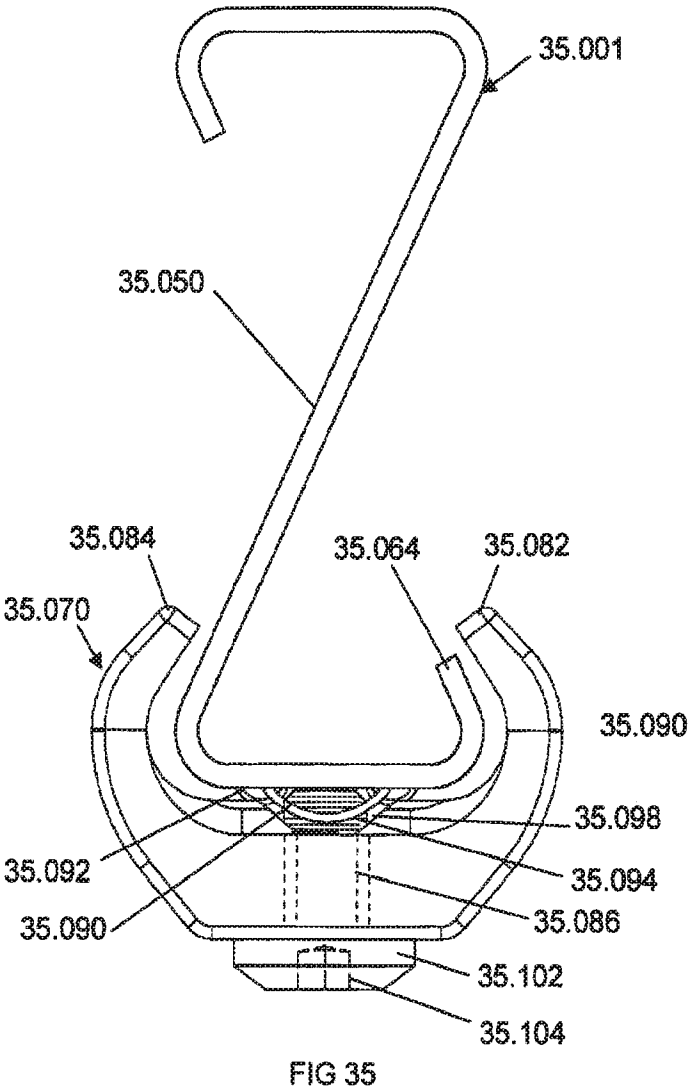
FIG. 35 is a plan view of the assembled components of FIG. 34, assembled with a bolt.
Figure 34:
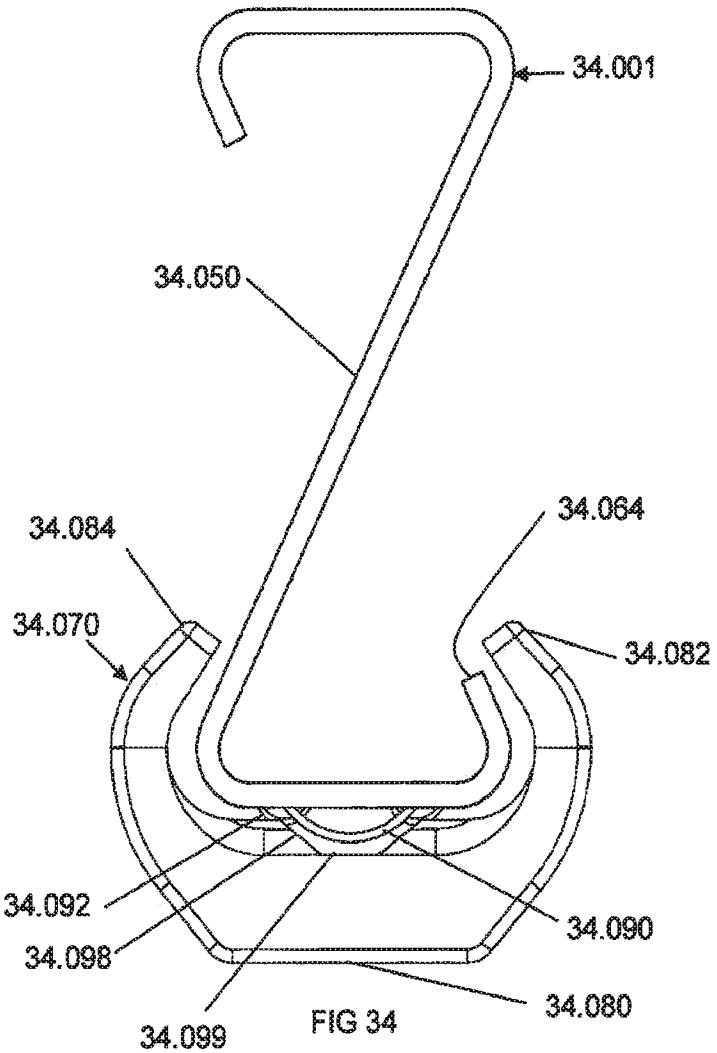
FIG. 34 is a plan view the post and carriage of the barrier of FIG. 33.

FIG. 34 depicts plan views of the carriage 34.070 and the Z post 34.001 without a bolt, and FIG. 35 with a bolt 35.094. FIGS. 34 and 35 are represented schematically and not to scale. In particular, the space between the carriage and the post is not a true representation of the amount of clearance provided. In practice, it is expected that approximately 1 to 4 millimeters will be the amount of clearance provided between the outer surfaces of the post and the inner surface of the carriage, as is described in co-pending application PCT/AU2010/000321.

The engagement between the carriage 34.070 and the post 34.001 can occur in the region of carriage's middle section 34.080, and the carriage free ends 34.082 and 34.084 which may contact the trailing end 34.064 and the oblique segment 34.050 of the post 34.001 respectively. The clearance allows the carriage 34.070 to move relatively freely relative to the post 34.001 during a collision. The provision of the clearance also makes it easier to control the performance of the barrier, as it is not adversely affected by friction between the carriage 34.070 and the post 34.001. Also, the free ends 34.082 and 34.084 are close enough together so that the front or outer face 34.088 of the post 34.001 cannot fit between the free ends 34.082 and 34.084. This ensures the carriage 34.070 is retained on the post 34.001 for its longitudinal movement along and relative to the post 34.001, and the movement is guided thereby. The movement of the carriage 34.070 relative to the post enables the beam to stay at approximately an appropriate height relative to the vehicle colliding against the beam, until the carriage 34.070 breaks apart from the post 34.001.

The carriage's threaded hole 34.086 opens toward the Z-post 34.001 into the recess 34.098. The recess 30.098 is dimensioned so that it will not interfere with the engagement means 34.090. The edge around the recess 30.098 abuts with the non-centrally located carriage support means 34.092, so that the bottom of carriage 34.070 can rest on the carriage support means 34.092. The post 34.001 can be provided with one or more carriage support means, each defining a beam location.

Alternatively as illustrated in FIG. 48, each carriage support means can be a single projection provided along the post 34.001, so that threaded bolt 34.094 can rest on the single projection. Projections intended to retain the carriage on the post 34.001 can be thinner than projections intended to absorb the impact from a collision (i.e. projections of the engagement means), as they are required only to carry the weight of the carriage and the beam.

E. Assembly—Carriage, Bolt, and Post

Referring to FIG. 35, the threaded bolt 35.094 is adapted to pass through the threaded hole 35.086 and laterally through the recess 35.098. The bolt 35.094 passes laterally in the sense that it passes through the recess in a direction that is lateral to the longitudinal direction of the recess 35.098. The distal end 35.100 of the bolt 35.094 extends past the outer most portion of the engagement means 35.090 so that the end of the bolt 35.094 will engage the engagement means 35.090 when the carriage 35.070 moves along the post 35.001. The carriage 35.070 is therefore prevented from freely riding over the engagement means 35.090, until a collision of sufficient force occurs and the engagement means 35.090 are fractured or deformed. The head 35.102 of the bolt 35.094 can have an Allen key hole 35.105, to facilitate tightening the W beam (not shown) onto the carriage 35.070. The beam would be located between the head 35.102 and the front face of the carriage 35.070.

Figure 65:
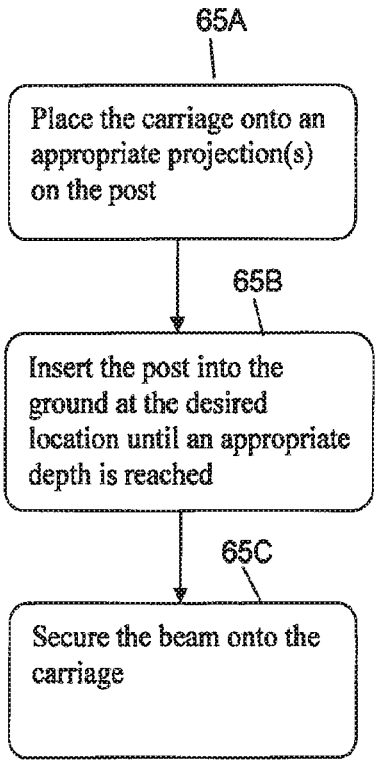
FIG. 65 is a flow chart depicting a method for assembling the post, carriage, and beam.
Figure 68:
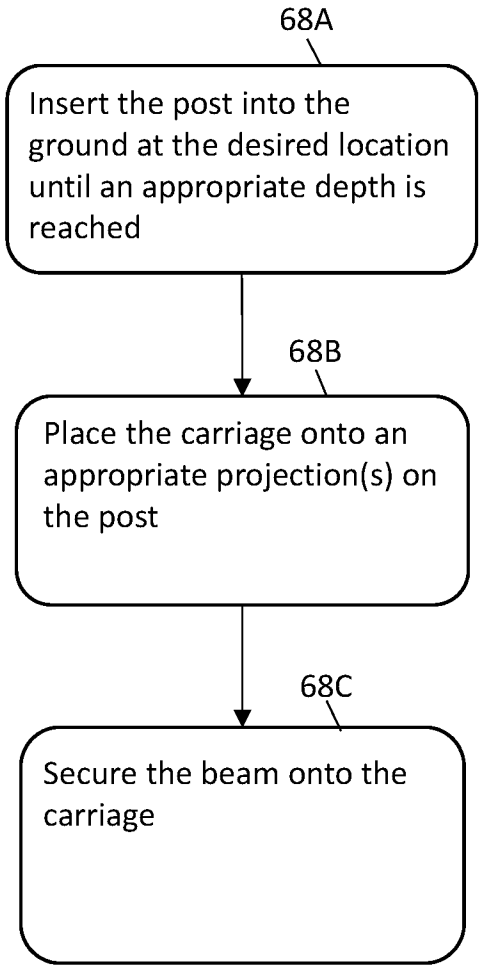
FIG. 68 is a flow chart depicting a further method for assembling the post, carriage, and beam.

As illustrated in FIG. 68, the carriage, bolt, and post can be assembled by first driving the post into the ground (step 68A), placing the carriage at a desired location on the post (e.g. a carriage stop means) in step 68B, and then attaching the beam onto the carriage in step 68C by inserting an attachment screw through the beam and into the threaded through bore of the carriage. Alternatively as illustrated in FIG. 65, the carriage can be placed onto projections on the post in step 65A, before the post is driven into the ground in step 65B. As described in this specification the projections can be those of a carriage stop means or a carriage engagement means, depending on the embodiment of the post used. The projections are selected so that the beam will be positioned at an appropriate height for acting as a barrier.

Figure 66:
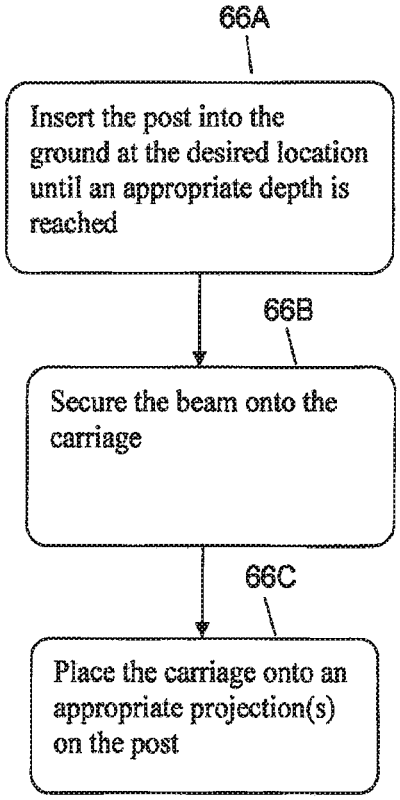
FIG. 66 is a flow chart depicting another method for assembling the post, carriage, and beam.
Figure 67:
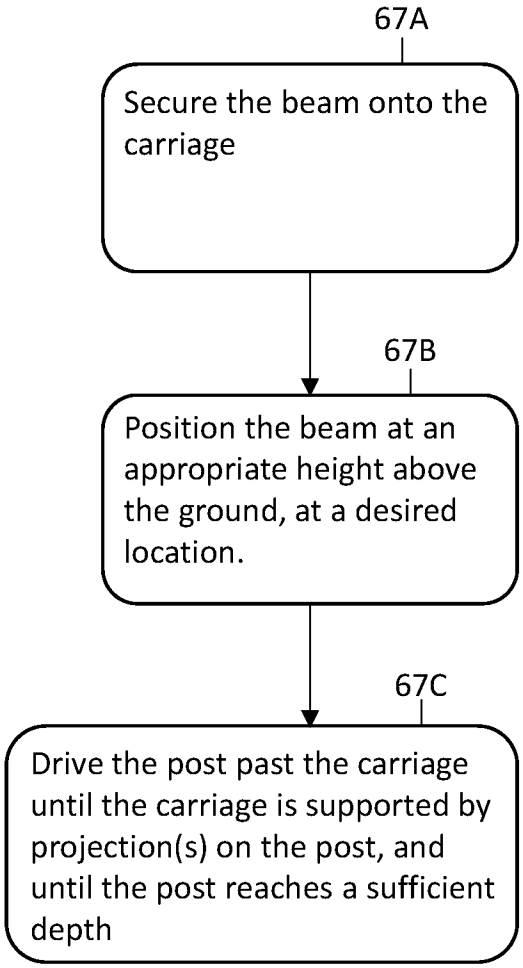
FIG. 67 is a flow chart depicting a further method for assembling the post, carriage, and beam.

The beam can then be attached to the carriage in step 65C. Alternatively as illustrated in FIG. 66, the beam can be pre-attached to the carriage by inserting the attachment screw through the beam and into the threaded bore of the carriage in step 66B. The attached rail and carriage can then be placed onto the appropriate carriage stop means on a post (step 66C) that has already been driven into the ground (step 66A). Alternatively as illustrated in FIG. 67, the carriage and beam are pre-attached by inserting the attachment screw through the beam and into the threaded bore of the carriage in step 67A. The pre-attached carriage and beam are then positioned with the beam on its desired location with respect to the ground in step 67B. The post can then be positioned to be driven into the ground, passing through the carriage in step 67C, until it reaches a sufficient depth so that the assembly is stable. The carriage will in effect travel upwardly with respect to the post. In this instance, the carriage stop means will be configured so that the carriage can travel upwardly with respect to the post, ride past the location of the carriage stop means, and then move into position once it passes the carriage stop means, so that the carriage is supported by the carriage stop means. For example, the carriage stop means depicted in FIG. 38, which has a tab that extends upwardly and outwardly, can be used. Alternatively, a bolt can be used as a carriage stop means, and is inserted when needed.

F. Operation of Barrier Assembly

When a collision occurs and the beam is impacted by a vehicle, the force of the impact can cause the carriage 35.070 to move along the post 35.001 depending upon the magnitude of the collision force. The carriage 35.070 and thus the beam will however be stopped, possibly temporarily, or retarded in its relative movement, by the engagement means 35.090 engaging the bolt 35.094.

In the event that a forceful enough impact causes the carriage 35.070 to break through the first engagement means 35.090, the now diminished force will move the carriage 35.070 toward the next engagement means 35.090. The movement of the carriage 35.070 will then be retarded or stopped by the next engagement means 35.090, until the next engagement means 35.090 is also overcome by the collision force. The more engagement means that are provided, the more force the barrier can absorb. Also, the more force it takes to deform, fracture, or shear the dams or carriage engagement means 35.090 from the Z post 35.001, the more force the barrier can absorb, not just by the force of breakage, but also the beam remaining in contact with the post for longer, with the post thus absorbing greater force. The amount of force that the barrier can absorb will be affected by the number of engagement means provided, and also the shearing force required to overcome each engagement means.

Although the post is depicted as a Z post, it is to be understood that other types of posts can be used, as long as the engagement means can be provided on these posts. For instance, Charlie posts, H posts, I posts, C posts, U posts, rectangular posts, O posts can be used.

There are different types of failure mechanisms by which the engagement means can fracture. The attachment means, e.g. a bolt, can cause the engagement means 30.090 to be sheared off the post 30.001. Alternatively the attachment means can cause the engagement means to deform, for example to start necking, as it exerts a deformation force on the projection. The attachment means can then ride through the engagement means when sufficient deformation or fracturing has occurred. The engagement means and interaction with a bolt, assist provide consistent and reproducible failure, allowing one to anticipate approximately the amount of force required for the carriage to overcome the engagement means in a collision.

G. Variations

1. Carriage Support/Stop Means Variations

Figure 37:
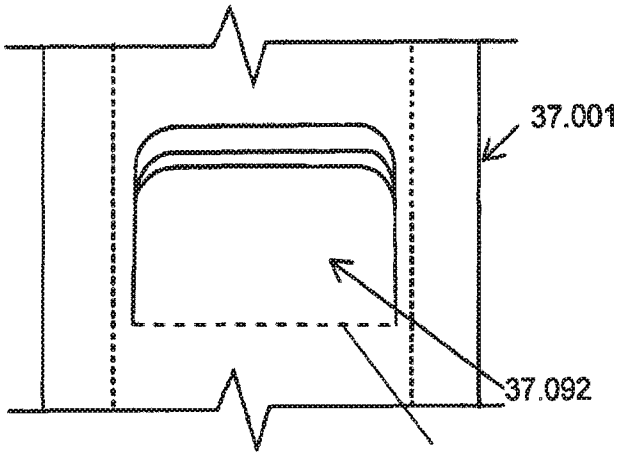
FIG. 37 is a front elevation view of the carriage support means shown in FIG. 36.
Figure 36:
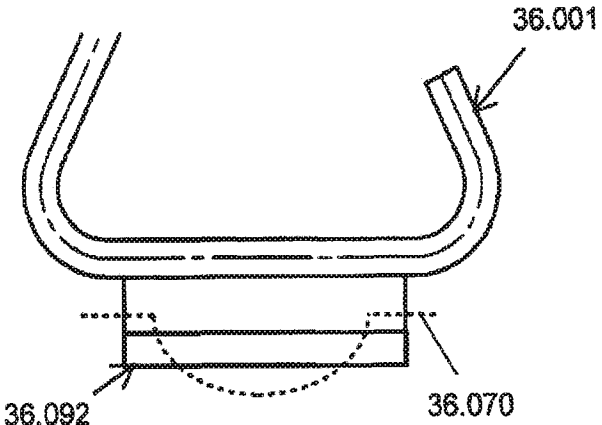
FIG. 36 is a part plan view of a Z-post showing a carriage support means.
Figure 38:
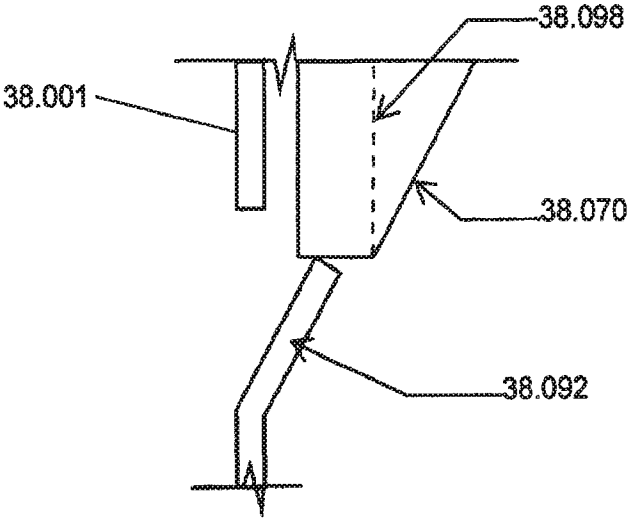
FIG. 38 is a side sectional view of the carriage support means shown in FIG. 36, showing engagement with a carriage.

FIGS. 36 to 41 depict various embodiments of carriage support means in the form of tabs that are cut and bent out from the post. For instance they can be cantilevered tabs that are formed by shearing and bending a part of the post. Referring to FIGS. 36 to 38, the carriage support means 36.092 can be a tab that is cut from the post 36.001 and then pushed out or punched out, but which remains hingedly connected to the post 36.001. The carriage 36.070 in use rests atop the tab 36.092 so that it does not slide down the post 36.001. The tab 37.092 is cut and then detached from the post 37.001, except at its lower edge 37.093. The tab 37.092 is connected to the post along a generally horizontal attachment edge 37.093 and extends outwardly from the edge 37.093. The tab 36.093 extends or is of a width which is wider than the recess 36.098. As shown in FIG. 38 the carriage 38.070 sits atop the tab 38.092, so that the tab 38.092 retains the carriage 38.070 but does not interfere with the bolt (not shown) for attaching the barrier to the carriage 38.070.

Figure 40:
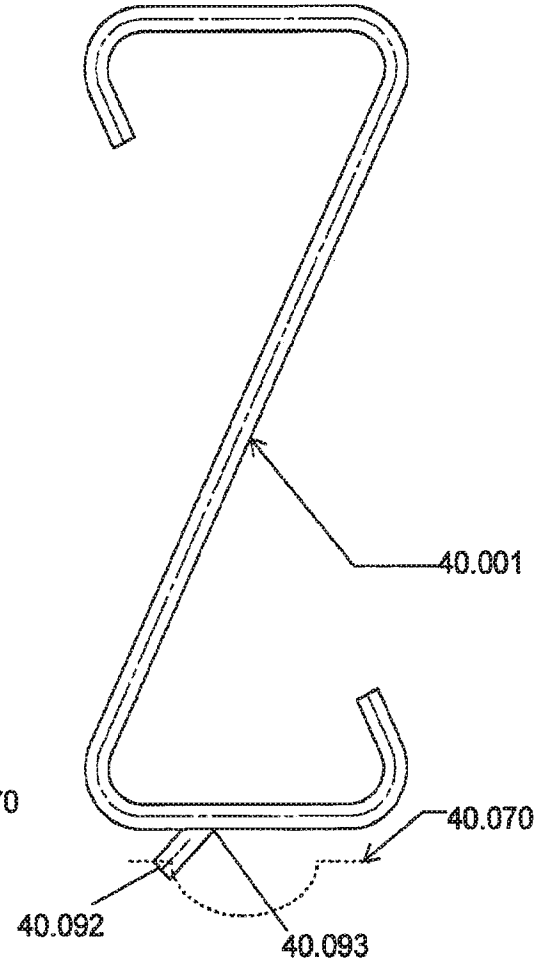
FIG. 40 is a plan view of a further carriage support means.
Figure 39:
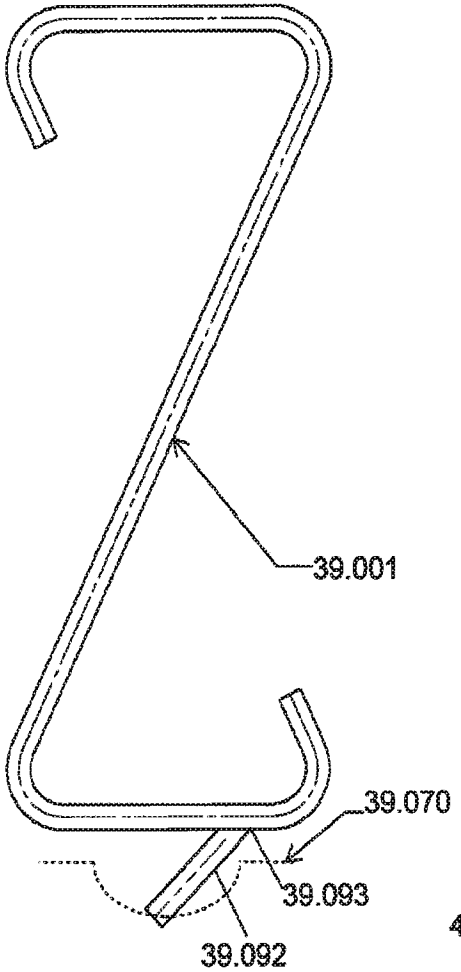
FIG. 39 is a plan view of another carriage support means.
Figure 46:
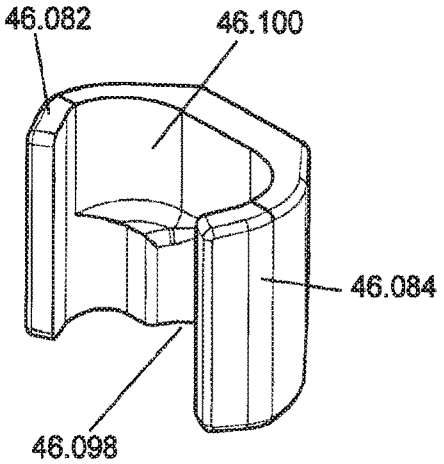
FIG. 46 is a rear perspective view of the carriage of FIG. 42.
Figure 45:
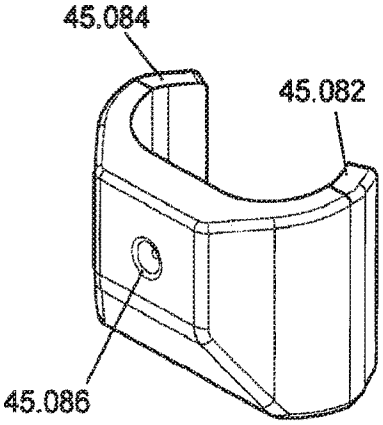
FIG. 45 is a front perspective view of the carriage of FIG. 42.
Figure 42:
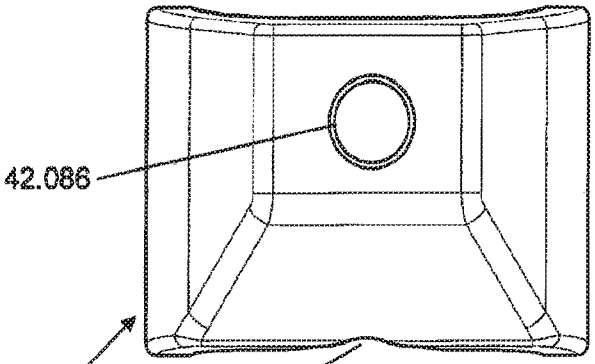
FIG. 42 is a front elevation view of the carriage of FIG. 30.
Figure 47:
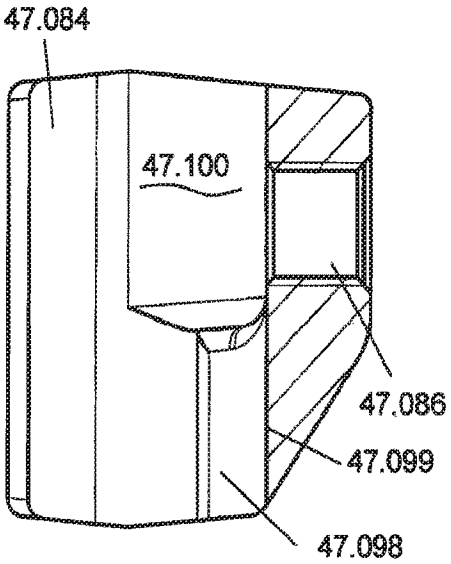
FIG. 47 is a section of the carriage of FIG. 42 through line XLVII-XLVII of FIG. 43.
Figure 43:
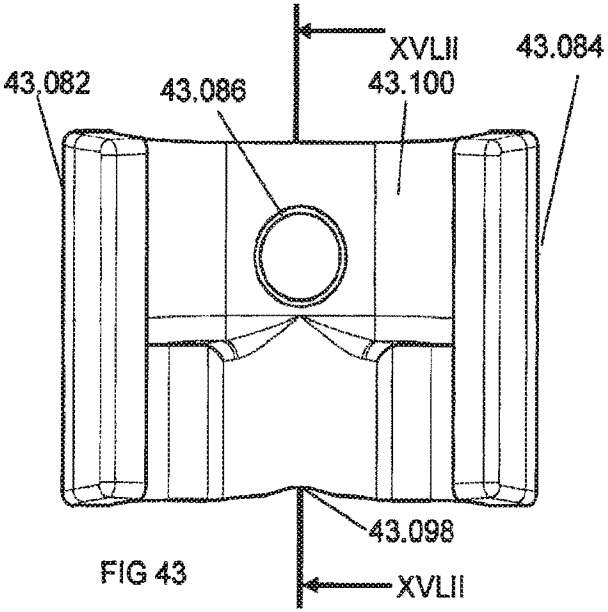
FIG. 43 is a rear elevation view of the carriage of FIG. 42.
Figure 44:
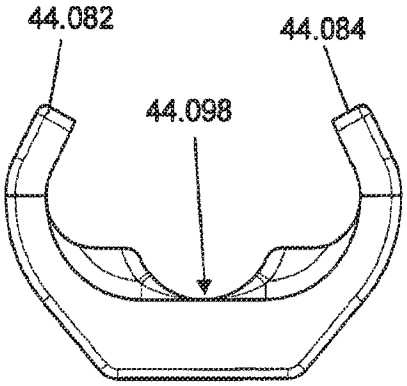
FIG. 44 is a plan view of the carriage of FIG. 42.

The carriage stop tab can be differently orientated than as described above, as is shown in FIG. 39. The retaining tab 39.092 is attached to the post 39.001 along a longitudinal or generally vertical line of attachment 39.094. The tab 39.092 extends toward the carriage 39.070 so that in use it supports the carriage 39.070 at a location below the recess 39.098. As shown in FIG. 40, the tab 40.092 alternatively extends from the longitudinal attachment edge 40.093 so that it supports the carriage 40.070 at a location below the rim of the recess 40.098.

Figure 41:
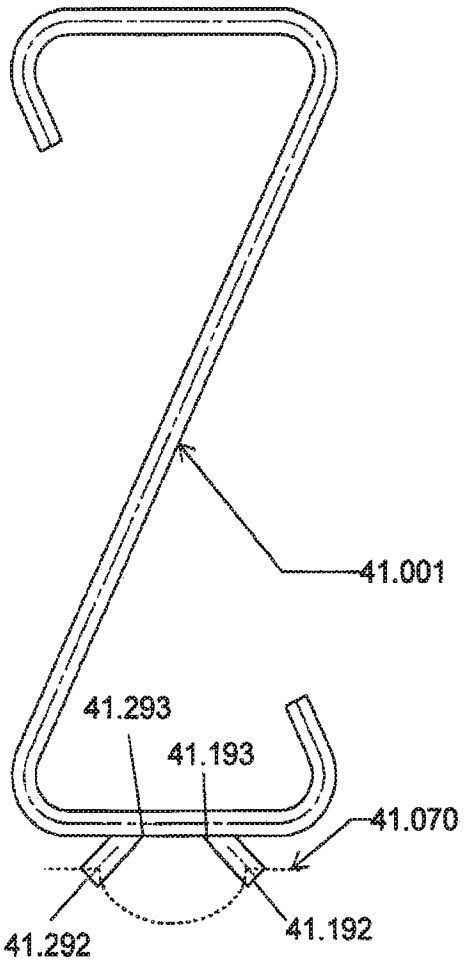
FIG. 41 is a plan view of another carriage support means.
Figure 57:
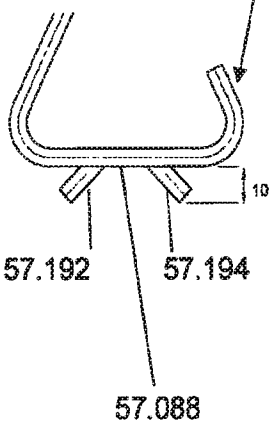
FIG. 57 is a plan view of a carriage support means.
Figure 72:
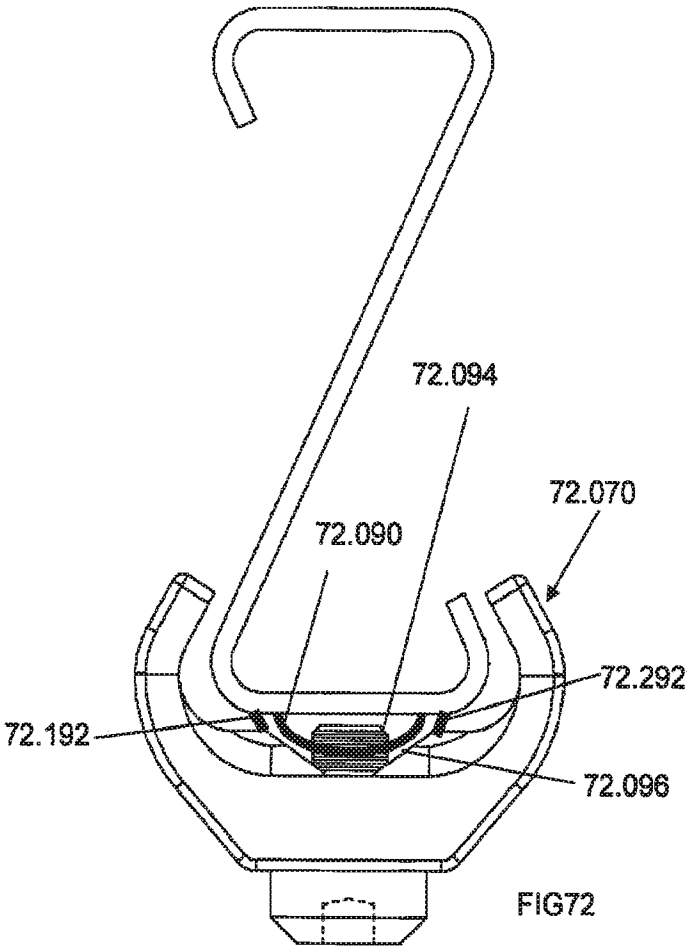
FIG. 72 is a plan view of the carriage and post in FIG. 71 and of a bolt for use with the carriage and post.
Figure 71:
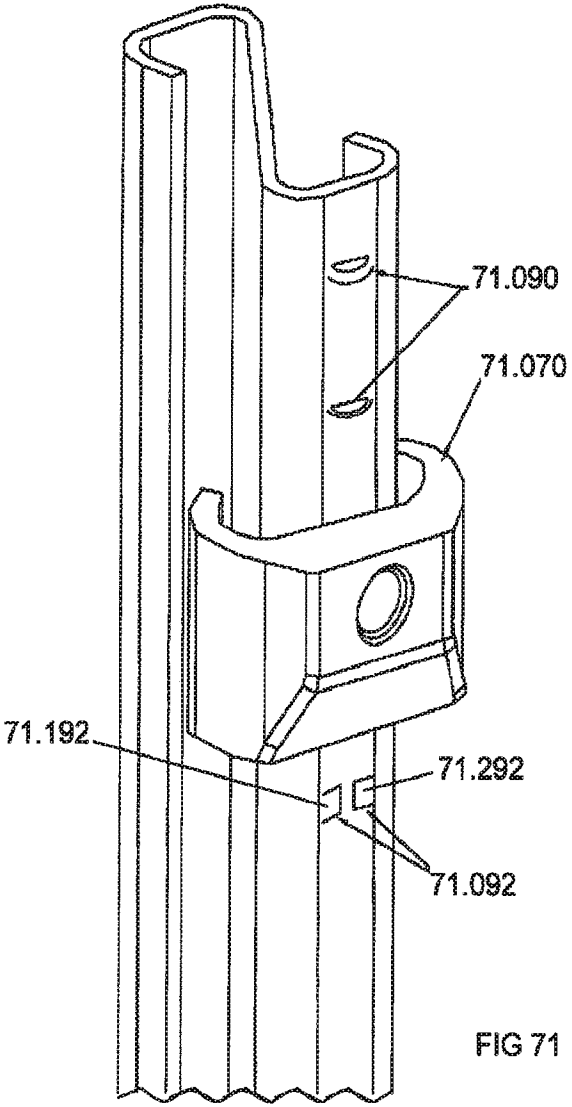
FIG. 71 is a front perspective view of another carriage and post combination.

Illustrated in FIG. 41, a different carriage stop means 41.092 includes a pair of retaining tabs 41.192 and 41.292. Each tab is attached to the post 41.001 along a corresponding longitudinal or generally vertical line of attachment 41.193 (and 41.293). The tabs 41.192 and 41.292 extend from their corresponding attachment edges 41.193 and 41.293 so that they support the carriage 41.070 at locations below the floor of the recess 41.098. As shown FIG. 57, tabs 57.192 and 57.292 extend out they are about 10 mm proud of the front face 57.088 of the post 57.001. It will be understood that this dimension is an example only. It will also be understood that the retaining tabs need not have a specific configuration, as long as the tab (or multiple tabs which work together) extends away from the outer surface of the post in such a way that it supports the carriage. For example, in the embodiment shown in FIGS. 71 and 72, the support means includes a pair of tabs 71.192, 71.292 as described above, and the engagement means 71.090 each include a single projection for engaging the bolt 72.094 as described previously. The carriage 71.070 is adapted to engage engagement means 71.090 which are single projections from the front or outer surface 71.088 of the post 71.001. The carriage 72.070 also has a recess 72.096 for accommodating the engagement means 72.090.

The preferred method of making the post and the carriage supports and resistance means or tabs, is to first form the post profile, either by pressing or roll forming, and then to punch the resistance tabs, to their desired configuration. Other methods of manufacture will be described below.

2. Carriage Engagement Means Variation

Figure 74:
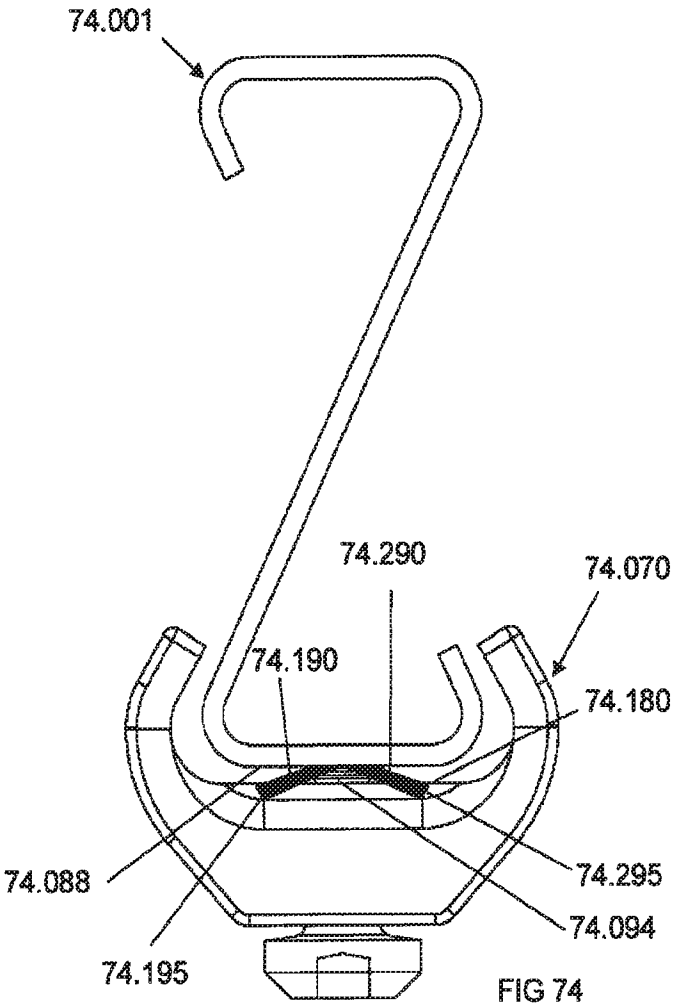
FIG. 74 is a plan view of the carriage and post in FIG. 73 and of a bolt for use with the carriage and post.
Figure 73:
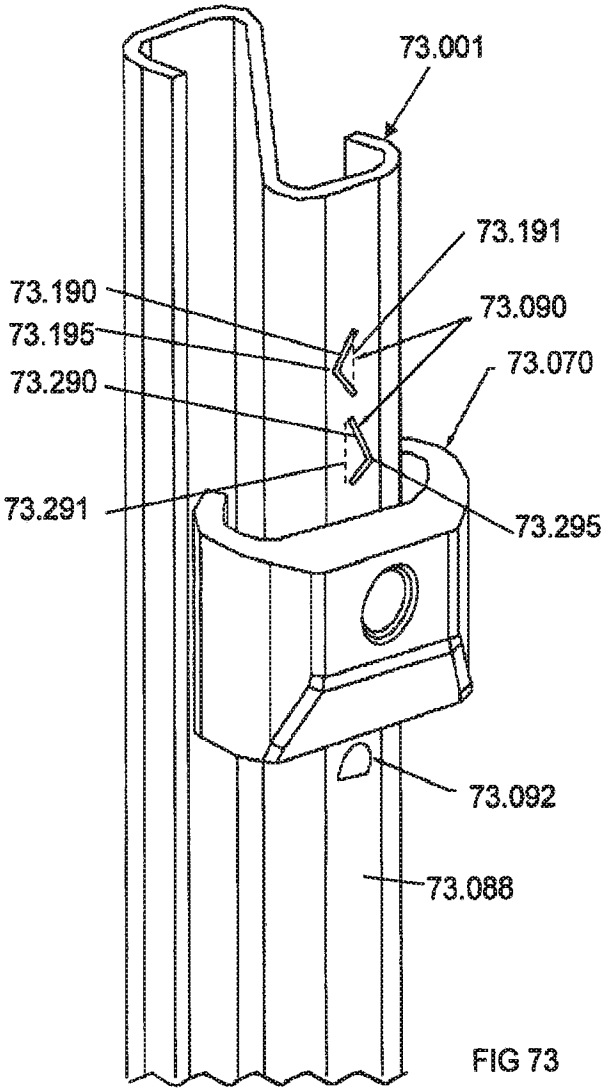
FIG. 73 is a front perspective view of another carriage and post combination.

FIGS. 73 and 74 depict a variation of the engagement means. The carriage engagement means 73.090 includes one or more triangular friction tabs 73.190 and 73.290 located on the front or outer face 73.088 of the Z post 73.001. In the embodiment shown in FIGS. 73 and 74, two friction tabs 73.190 and 73.290 which are angled away from each other are provided.

The friction tabs 73.190 and 73.290 can each have an approximate triangular shape, and can be attached to the outer face 73.088 of the post 73.001 along attachment edges 73.191 and 73.291 that are each generally parallel to, or along the longitudinal center line of the front or outer face 73.088. The remaining edges of the tabs are detached from the outer face 73.088. The apexes 73.195 and 73.295 of the tabs located opposite the attachment edges 73.191 and 73.291 point away from the longitudinal center line of the front or outer face 73.088. As shown in FIG. 74, in use the tabs 74.190 and 74.290 extend from approximately the longitudinal center line of the front or outer face 74.088, toward the carriage 74.070, so that they engage the inner surface 74.180 of the carriage 74.070.

Because of the tabs' triangular shape, the force required for the carriage 74.070 to deform each tab 73.190 or 73.290 increases as the carriage 74.070 is made to travel from the lowest point of the tab 73.190 or 73.290 to the detached apex 73.195 or 73.295 of the tab. This is because between the lowest points of its attachment edge and detached apex the tab is increasing in width, as measured in a direction that is transverse to the longitudinal direction of the post. After the carriage 74.090 overcomes the detached apex 73.195 or 73.295, the tab 73.190 or 73.290 releases the carriage 74.090, because the tab is decreasing in width between its detached apex and the highest point of its attachment edge. In this sense the carriage 74.070 is adapted to "click" past the friction tabs 73.190 and 73.290.

The two friction tabs 73.190 and 73.290 can be vertically displaced from each other. This arrangement provides different locations where the carriage 73.070 must overcome and click past the tabs. Also this arrangement prolongs the duration of contact between the engagement means 73.090 and the carriage 73.070 in the event of a collision.

For the carriage to overcome the engagement means 73.090, it needs to have been subjected to sufficient force such that its inner surface 74.180 can overcome the engagement with the apexes 74.195 and 74.295 of the tabs, and that the bolt 74.094 can overcome the bases of the tabs, near the attachment edges 74.191 and 74.291.

The prolonged contact between the engagement means and the carriage can be useful for heavy duty barrier arrangements for, e.g. areas with higher traffic from heavier vehicles such as trucks.

3. Post Variations

In an alternative embodiment of the post as shown in FIG. 48 (not to scale), the support means 48.092 includes a single projection and is formed in the same way as the engagement means. The bolt which attaches the beam to the carriage rests on the support means 48.092, and the support means thus supports the carriage.

Exemplary dimensions for a Z post with at least two engagement means and one support means are also provided in FIG. 48 (not to scale). The dimensions are provided in millimeters. The engagement means 48.090 are each approximately 30 mm in length as measured in a direction transverse to the direction of the carriage's travel, and each protrude about 6 mm proud of the front face of the post. In the example shown, the upper and lower engagement means 48.090 are approximately 7 to 7.5 mm in width, and the bottom carriage stop means 48.092 is approximately 4 mm in width, as measured in the direction of the carriage's travel. A 7 mm to 7.5 mm wide engagement means will typically fail when impacted by a collision of sufficient force, and will have the effect of delaying the separation of the carriage from the post, allowing the post to absorb as much impact as is possible by maintaining contact for as long as possible during the collision.

The bottom support means 48.092 supports the carriage (not shown), which will be located between the bottom support means 48.092 and the lower engagement means 48.090, which provides an initial restriction to the travel of the carriage relative to the post 48.001. The lower edge of the bottom support means 48.092 is provided at about 154 mm from the top of the post, and the lower edge of the lower engagement means 48.090 is provided at about 70 to 135 mm from the top of the post. In the case that the lower engagement means 48.090 is provided at 135 mm from the top, and the beam and carriage are attached together by a 13 mm bolt. Thus the carriage will travel only about 6 mm before it engages the lower engagement means 48.090. The lower edge of the upper engagement means 48.090 is provided at about 20 to 25 mm from the top of the post. The carriage will detach from the post if there is enough load to cause the upper engagement means 48.090 to fracture or deform. To accommodate an engagement means of the above given dimension, the carriage will have a recess 43.098 that is at least 35 mm wide (transverse to the post) and a depth of at least 6 mm, the depth being measured in the direction that is perpendicular to the front face of the post and to the carriage. The recess 43.098 also needs to be shaped to avoid contact with the engagement means If the Z-post is on a median strip, or between two carriageways or roadways, and is to have a carriage located on each opposed side, each to mount a beam thereto, then the formations which form the engagement means and support means, can be on both outer faces of the post.

Figure 58:
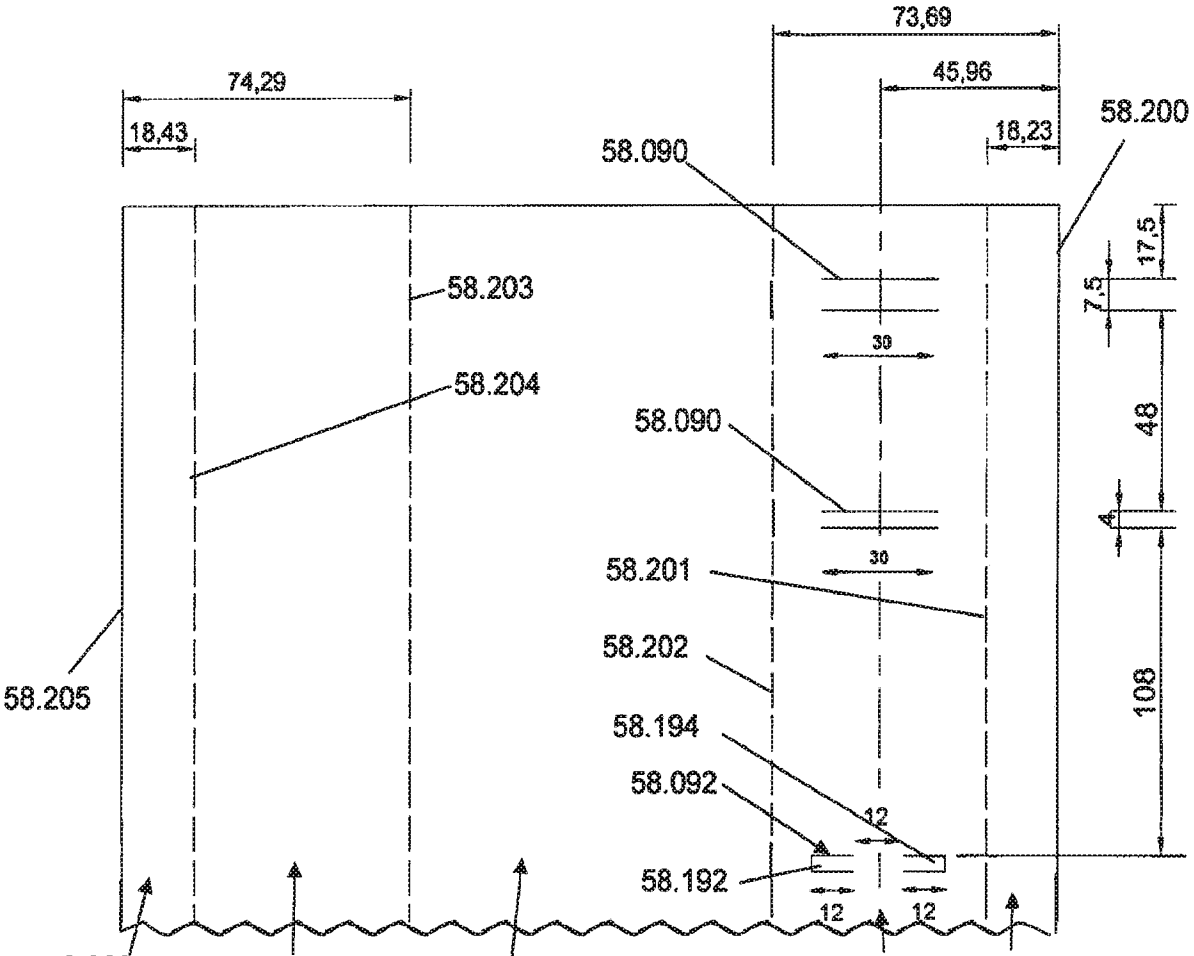
FIG. 58 is a schematic view of a blank for another post.

FIG. 58 depicts the schematic view (not to scale) of a blank for forming another Z post. Exemplary dimensions are provided in millimeters. Starting from the right hand side of the blank as shown in FIG. 58, the blank includes a first edge 58.200 and a first fold line 58.201 which define the front trailing end 58.064. The front face 56.088 extends between the first fold line 58.201 and the second fold line 58.202. From the second fold line 58.202, the oblique portion 58.050 extends until it meets the third fold line 58.203. The rear face 58.051 is defined between the third fold line 58.203 and the fourth fold line 58.204. The rear trailing end 58.063 of the Z post is defined between the fourth fold line 58.204 and the second edge 58.205 of the blank. The first fold line 58.201 is approximately 18.23 mm from the first edge 58.200. The second fold line 58.202 is about 73.69 mm from the first edge 58.200. A center line 58.206 through the front face 58.088 is therefore about 45.96 mm from the first edge 54.200. The third fold line is about 74.29 mm from the second edge 58.205, and the fourth fold line is about 18.43 mm from the second edge 58.205.

Slits are cut into the blank section corresponding to the front face 58.088, for forming the projections of two engagement means 58.090 and a carriage stop means 58.092. The engagement means 58.090 are each approximately 30 mm in width as measured in a direction transverse to the direction of the carriage's travel. Each engagement means will be punched from the post until it protrudes about 6 mm proud of the front face of the post. In the example shown, the upper and lower engagement means 58.090 are approximately 7.5 mm and 4 mm in width, respectively. The blank has slits for forming a carriage stop means 58.092 that includes two stop tabs 58.192, 58.292 spaced apart by about 12 mm. Each stop tab is about 12 mm in width, and will be punched from the post until it extends proud of the post by about 10 mm. The carriage stop means 58.092 and the lower engagement means 58.090 are separated by approximately 108 mm. The upper and lower engagement means are spaced apart by about 48 mm.

Figure 76:
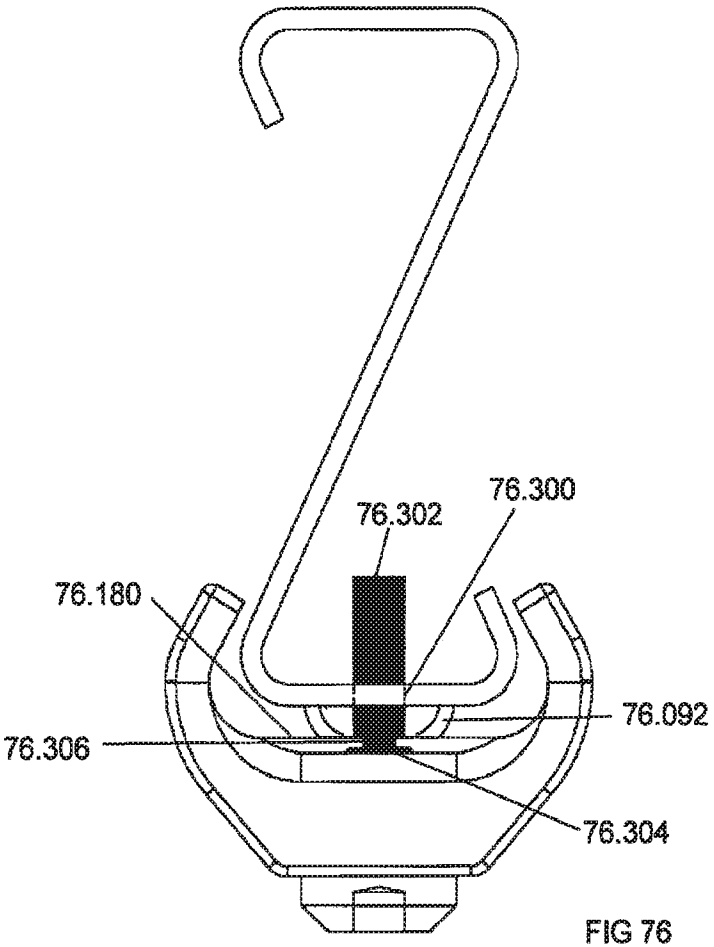
FIG. 76 is a plan view of the carriage and post in FIG. 75 and of a shear pin for use with the carriage and post.
Figure 75:
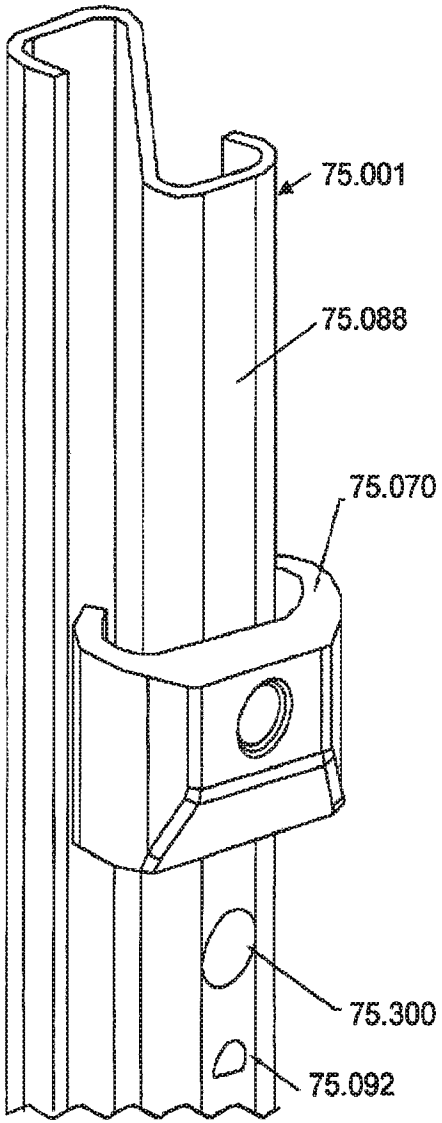
FIG. 75 is a front perspective view of another carriage and post combination.

FIGS. 75 and 76 depict another variation for the Z-post. 75.001. The front or outer face 75.088 of the post 75.001 can further have an aperture 75.300. As shown in FIG. 76 the aperture 76.300 receives a shear pin 76.302. The shear pin 76.302 has a head 76.304 which engages the inner surface 76.180 of the carriage 76.070. The shear pin 76.302 can further have a neck portion 76.306 that is thinner and hence is a weakened section. The neck portion 76.306 also engages the inner surface 76.180 of the carriage 76.070. In the course of a collision, the impact force drives the carriage 76.070 upwardly, and the carriage 76.070 in turn can cause the shear pin 76.302 to fail at the neck 76.306 if there is sufficient force.

While the above descriptions are directed to Z-posts, other profile or post cross sections can be used, including I-shape, H-shape, C-shape posts, or O-post.

4. Carriage Variations

Figure 50:
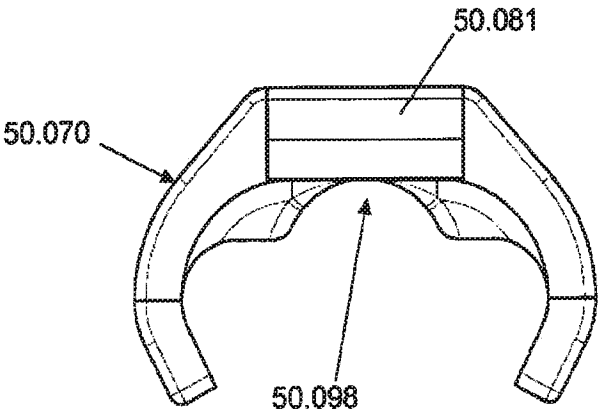
FIG. 50 is a plan view of the carriage in FIG. 49.
Figure 51:
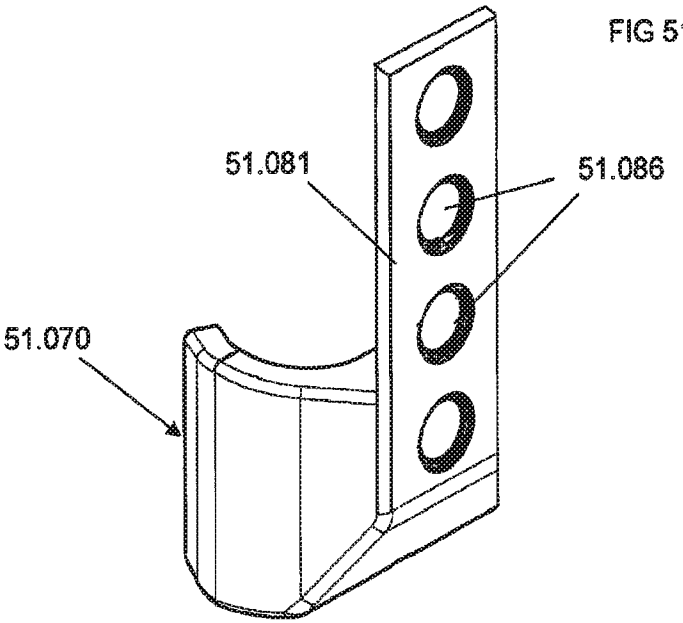
FIG. 51 is a front perspective view of the carriage in FIG. 49.
Figure 49:
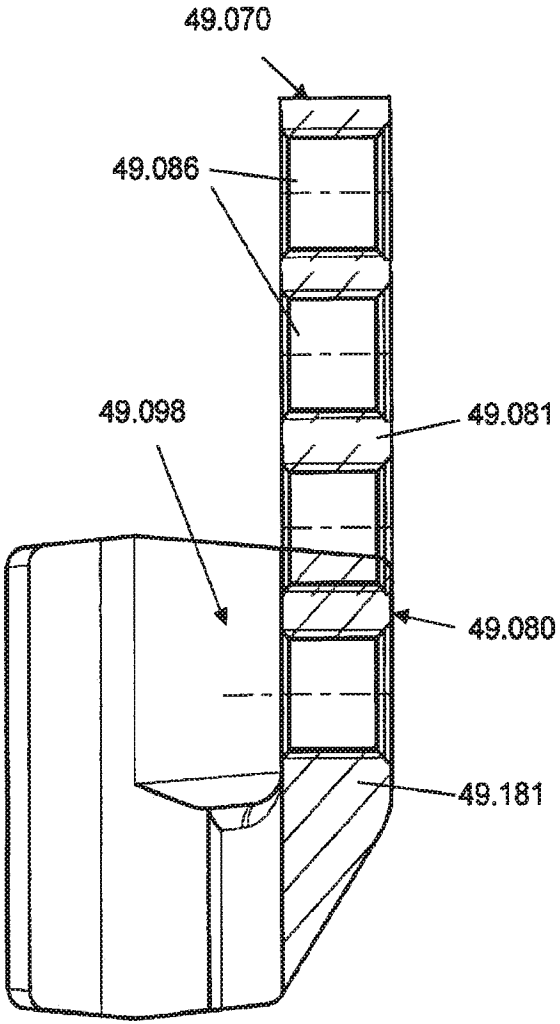
FIG. 49 is a side elevation view of another carriage.
Figure 53:
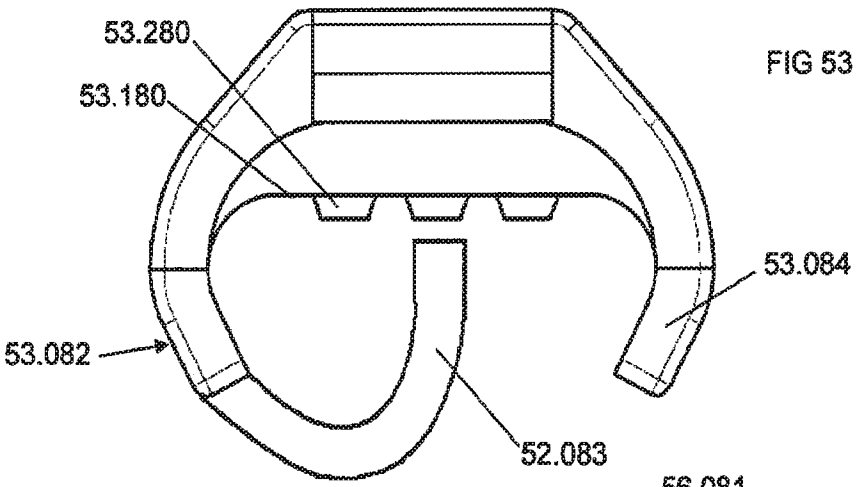
FIG. 53 is a plan view of the carriage in FIG. 52.

FIGS. 49 to 51 illustrate another carriage. Carriage 49.070 is similar to the carriage (e.g. 42.070), but is further modified to allow for multiple attachment positions for the beam. The middle section 49.080 of the carriage 49.070 has an extended flange 49.081 which extends away from the main body 49.181 of the middle section 49.080, and is provided with multiple threaded through bores 49.086 for the attachment of the beam (not shown). Each through bore 49.086 defines one attachment positions for the beam.

Figure 64:
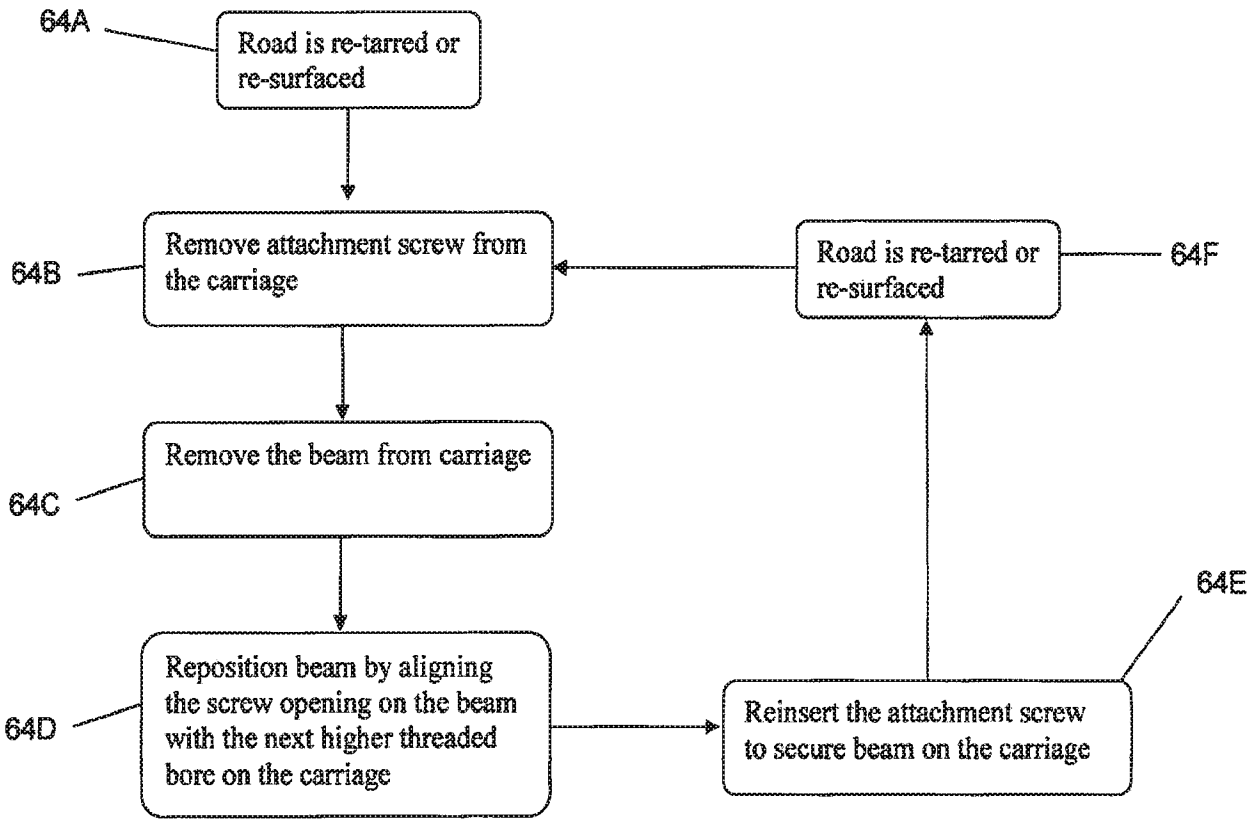
FIG. 64 is a flow chart depicting a method of raising the beam after the road has been retarred.

FIG. 64 illustrates a method of repositioning the beam after the road has been resurfaced. Roads can be surfaced from time to time. Each time the road is retarred or resurfaced (step 64A), the top surface of the road becomes slightly raised with respect to a roadway barrier that is already installed beside the road. By means of the carriage 49.070 the beam can thus be raised when it becomes desirable to do so, while the location of the carriage on the post does not change, for example when the road has been resurfaced enough that the beam would otherwise no longer be located at an appropriate height for acting as a barrier for vehicles. This is done by firstly removing the attachment means, e.g. a screw, which secures the beam at a position corresponding to a lower threaded bore, in step 64B. The beam is then removed from the carriage in step 64C and repositioned so that its bolt opening aligns with a higher threaded bore on the carriage, in step 64D. The screw is then reinserted to secure the beam onto the carriage in step 64E. If the road is retarred again in step 64F, steps 64B to 64E are repeated so that the beam can again be repositioned. It will not be necessary to remove the post and the beam and then reinstall the barrier assembly to locate the beam at the right position. Typically, the asphalt overlay(s) or resurfacing may require that the beam be raised by up to 200 mm. The provision of multiple threaded bores 48.086 allows the height of the beam to be raised in stages.

FIGS. 52 to 55 illustrate a further carriage. Carriage 53.070 includes a middle section 53.080 flanked by two free ends 53.082, 53.084. The inner surface 53.180 of the carriage 53.070, facing away from the roadway and toward the post (not shown), has one or more bearing pads 53.280 that are proud of the inner surface 53.180 of the middle section. One of the free ends is a hooked free end 53.082 that terminates in a hook 53.183. The hook 53.183 turns toward the inner surface 53.180 of the carriage 53.070 but does not reach the depth of the bearing pads 52.280, the depth being measured in a direction that is orthogonal to the inner surface 53.180 of the carriage 53.070 so as to accommodate and receive in the gap, the thickness of the post. The front section of the Z post 53.001 can fit between the hook 53.183 and the bearing pads 53.280, and the trailing end 53.064 of the post 53.001 is located in the nook area formed by the hooked free end 53.082. The hook 53.183 and the bearing pads 53.280 guide the movement of the carriage 53.070 on the post 53.001.

The middle section 52.080 itself has a threaded through bore 52.086 for the attachment of the beam as previously described. The threaded through bore 52.086 is located on a flange 52.081 which extends away from the main body 52.181, with the threaded through bore 52.086 being located away from the height at which the bearing pads 52.280 are located, so that the attachment bolt (not shown) will not interfere with the bearing pads 52.280. In this embodiment, the bearing pads can engage the engagement means but the engagement means will need to be formed in situ on site, or the carriage 53.070 assembled to the post from underneath the post, before the post is inserted into the ground. Another method would be to form the engagement means and/or the carriage stop means after the carriage has been mounted on the post. The carriage 53.070 can also be used with a Z post which has no engagement means if desired.

Figure 56:
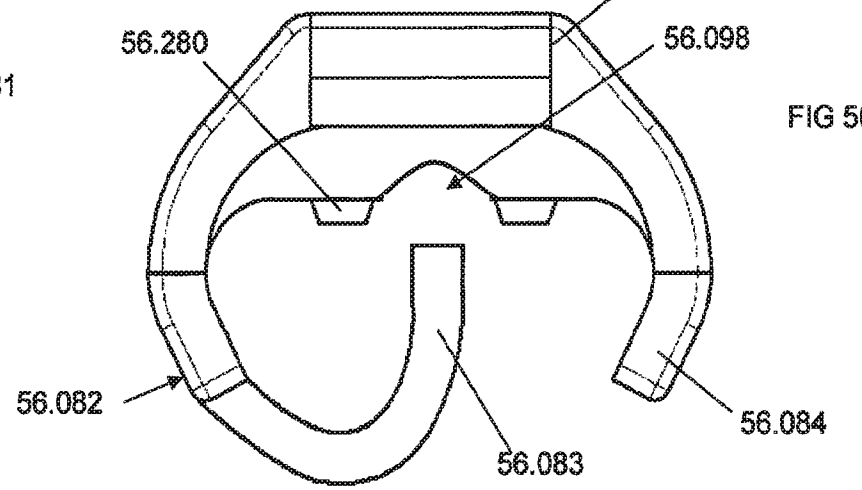
FIG. 56 is a plan view of another carriage.
Figure 52:
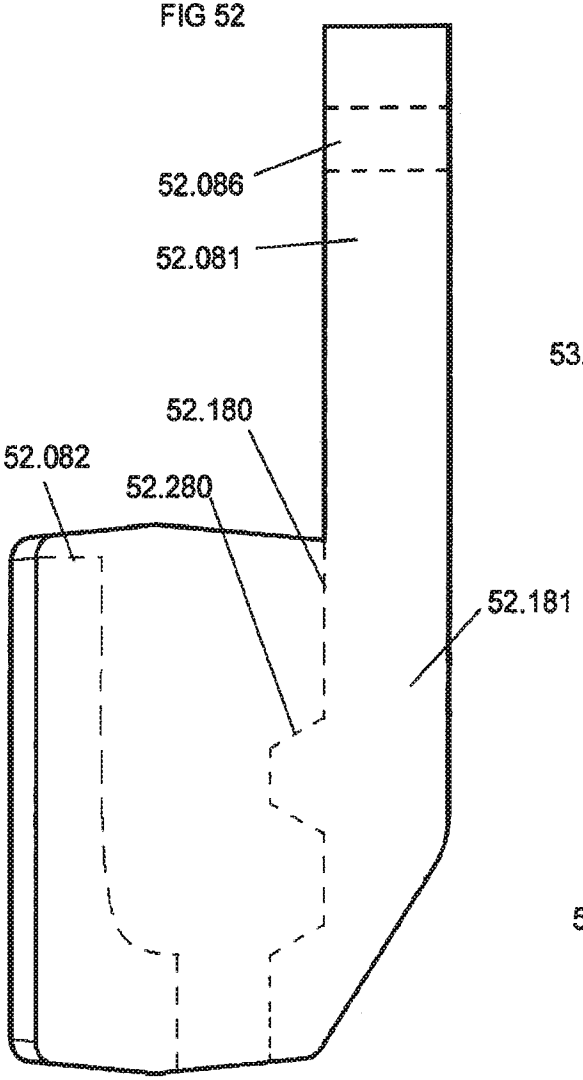
FIG. 52 is a side elevation view of another carriage.
Figure 55:
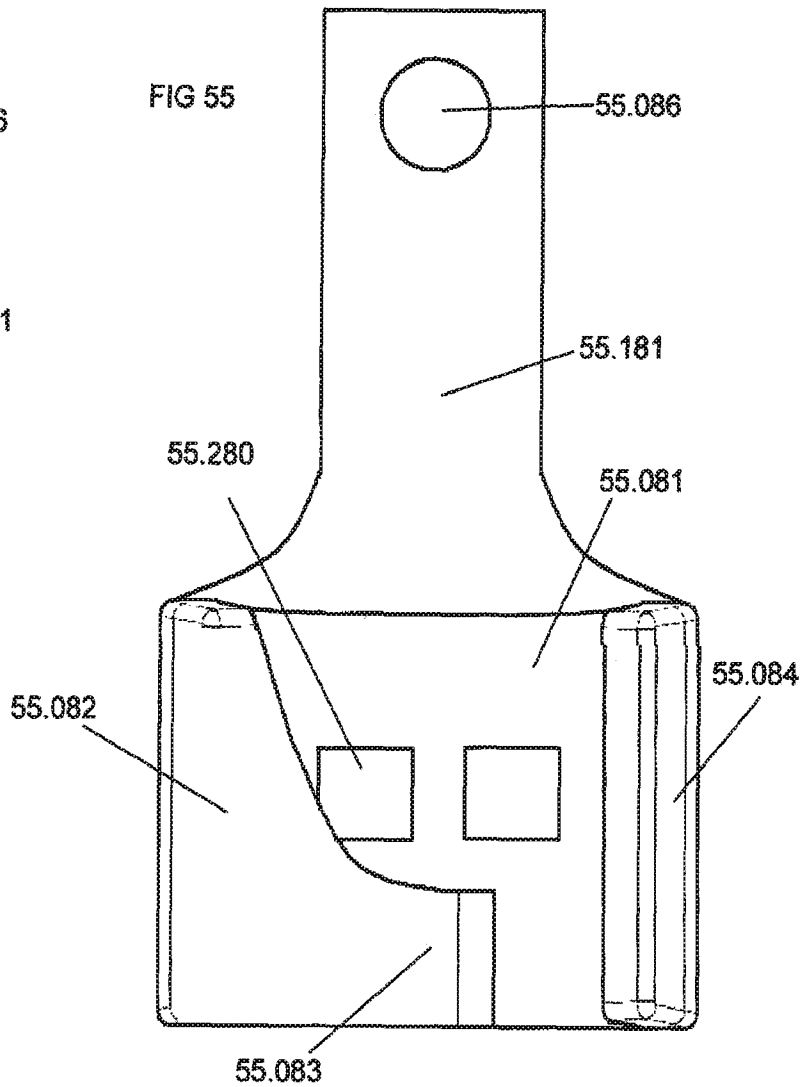
FIG. 55 is a rear elevation view of the carriage in FIG. 52.
Figure 54:
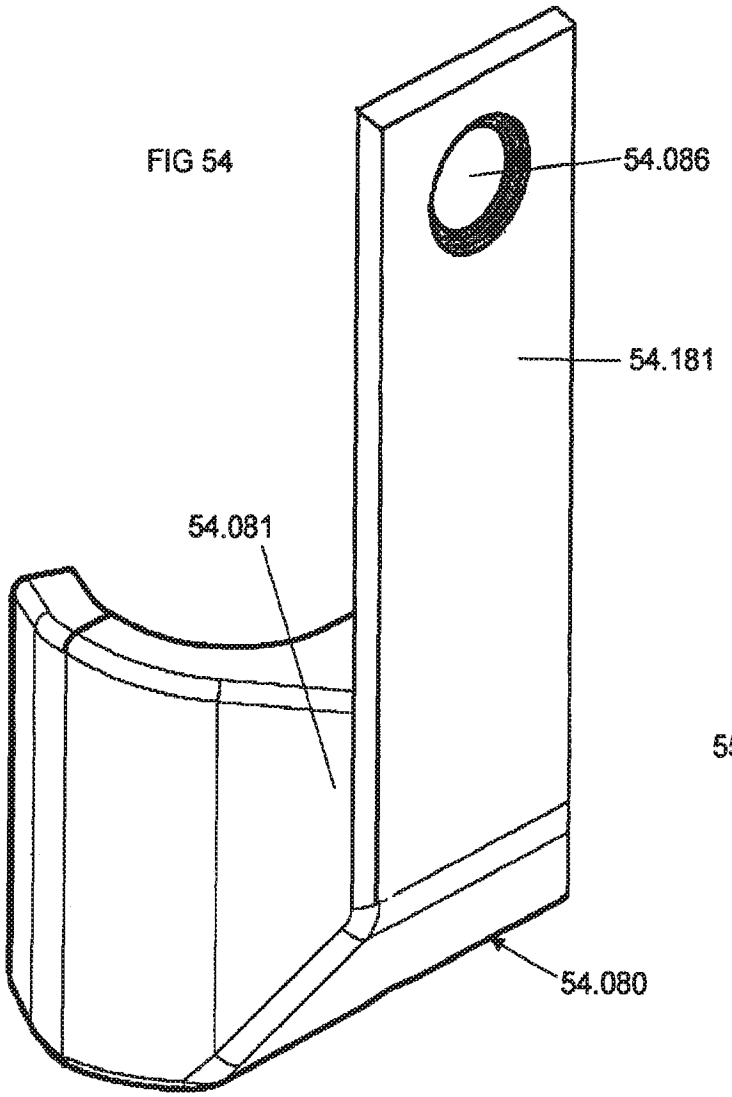
FIG. 54 is a front perspective view of the carriage in FIG. 52.

FIG. 56 illustrates a carriage 56.070 similar to carriage 53.070 which has a hooked free end 56.082 and one or more bearing pads 56.280. However, the carriage 56.070 also has a recess 56.098 for accommodating the engagement means (not shown) as described above. In this case, the attachment through hole can be provided through the middle section 56.080 to open into the base of the recess 56.098 as illustrated in FIG. 35, or it can be provided through a part of the middle section 56.081 that extends away from the level of the free ends as shown in FIGS. 49 to 52.

Figure 59:
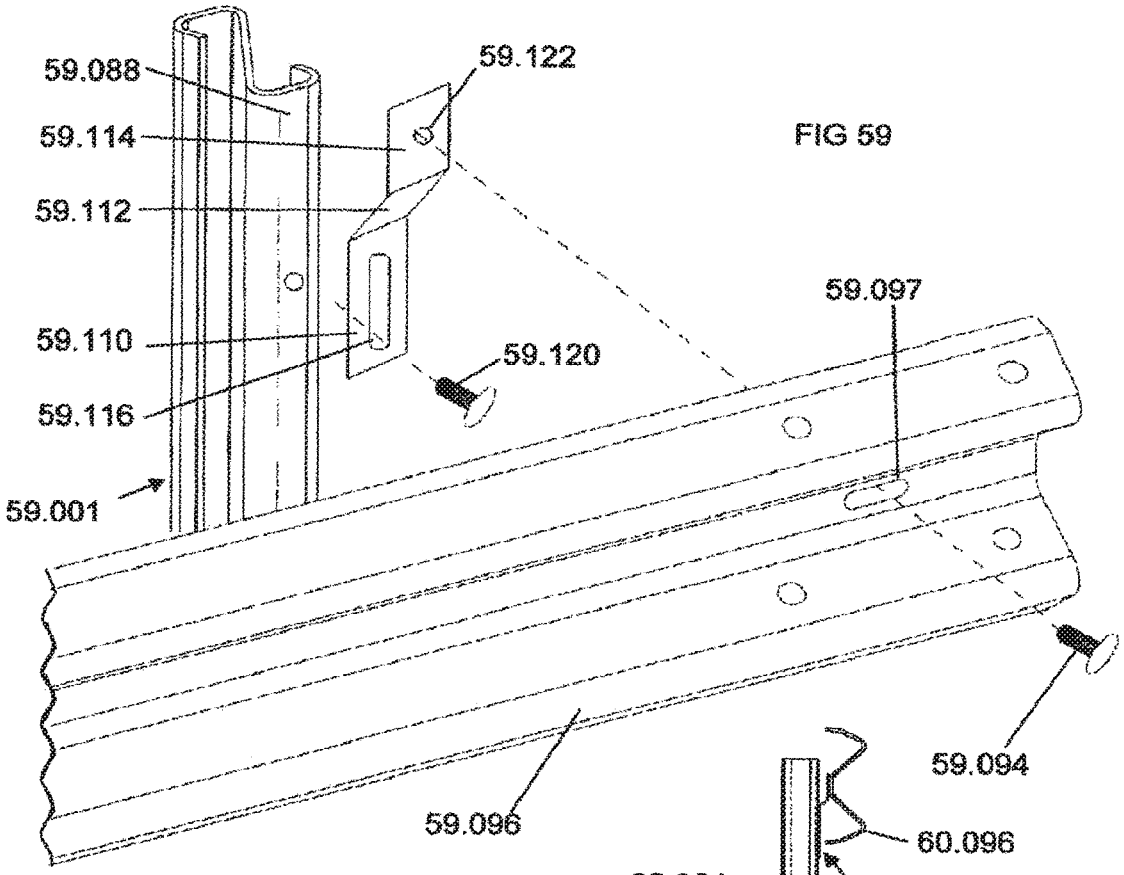
FIG. 59 is an exploded perspective view of another barrier assembly.
Figure 60:
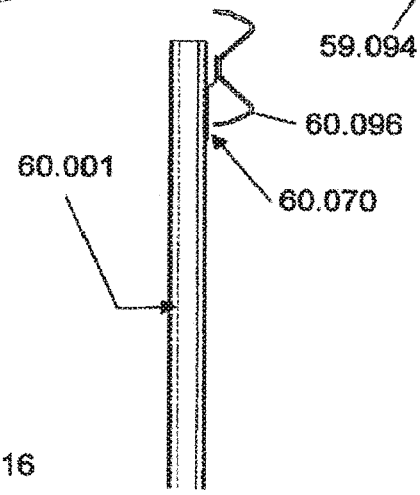
FIG. 60 is an elevation view of the barrier assembly in FIG. 59.

FIGS. 59 and 60 illustrate an alternative means of attaching the beam to the post. The carriage 59.070 is a bracket which includes a post attachment portion 59.110 which in use lies flush against the front face 59.088 of the post 59.001. The post attachment portion 59.110 is adjacent to an intermediate portion 59.112 which extends away from the post attachment portion 59.110 at an angle. The intermediate portion 59.112 connects the post attachment portion 59.110 to a beam attachment portion 59.114.

The post attachment portion 59.110 has an elongated opening 59.116, which is positioned adjacent to a post opening 59.118 located on the front face 59.088 of the post 59.001. The elongated opening 59.116 and also the post opening 59.118 receive a bolt 59.120 which attaches the bracket 59.070 to the post 59.001. The beam attachment portion 59.114 also has an opening 59.122, which in use aligns with the opening 59.097 on the beam. The openings on the beam attachment and the beam receive a bolt 59.094 for attaching the beam onto the beam attachment portion 59.114.

In the event of an impact the elongated opening 59.116 allows the upward travel of the bracket, and hence the beam 59.096.

Figure 83:
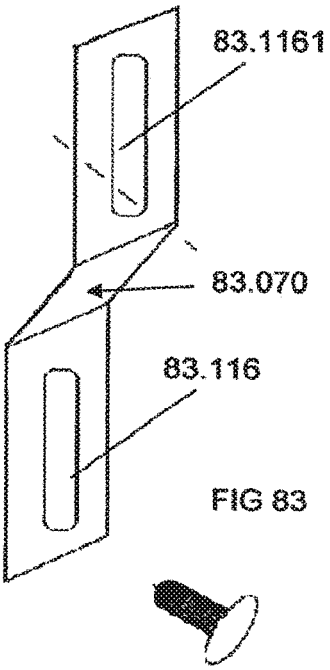
FIG. 83 is a perspective view of a dual slot carriage or bracket for use instead of bracket of FIG. 59.

Illustrated in FIG. 83 is a carriage 83.070, which is similar to that of carriage 59.070, except that an upper elongated slot 83.1161 is provided to slidably attach the beam 59.096 to, while the carriage 83.070 is attached by its elongated slot 83.116 to the post 59.001. By providing two slots and resting the bracket 83.070 so that the bolt is located at the top of slot 83.116, while the bolt holding the beam is located at the bottom of the slot 83.1161, means that the amount of movement available between the post and the beam is equal to the combined length of both slots 83.116 and 83.1161.

Figure 84:
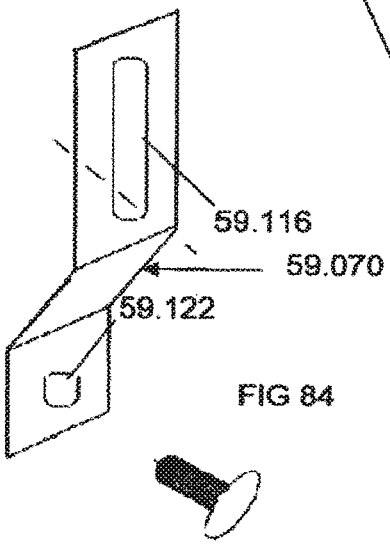
FIG. 84 is a perspective view of the carriage or bracket of FIG. 59, inverted for use to connect by a slot to the beam and a bolt hole to the post in FIG. 59.

Illustrated in FIG. 84 is the carriage 59.070 inverted, so that the single bolt hole is used to secure the carriage to the post, while the slot is used to attach the beam to the carriage, thus allowing the beam to translate, in the event of a collision, relative to the carriage.

The above embodiments of the barrier assembly have been shown to include a W beam. However other types of beams can be used. For instance, a THRIEBEAM (registered trade mark) 61.096 can be used, as shown in FIG. 61.

Figure 61:
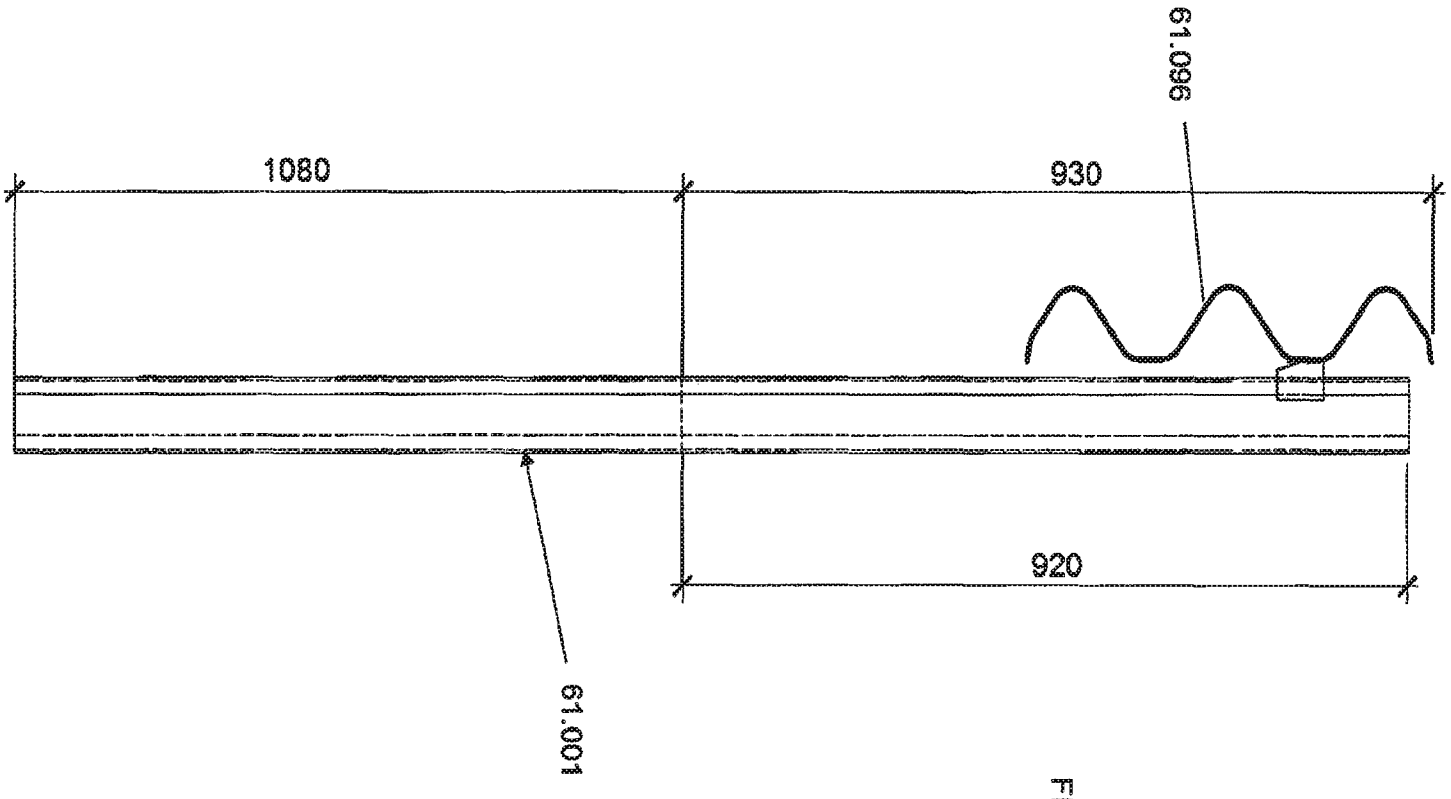
FIG. 61 is a side elevation view of an assembled barrier assembly with a THRIEBEAM.

FIGS. 61 and 79 to 82 depict, schematically, the vertical dimensions of the post with respect to the ground. As shown in FIG. 61, the post 61.001, which can be used with a THRIEBEAM can have an above ground part that is approximately 920 mm, and an underground part that is approximately 1080 mm. The top of the beam 61.096 can extend slightly beyond the uppermost part of the post, so that it sits at about 930 mm from the ground.

Figure 79:
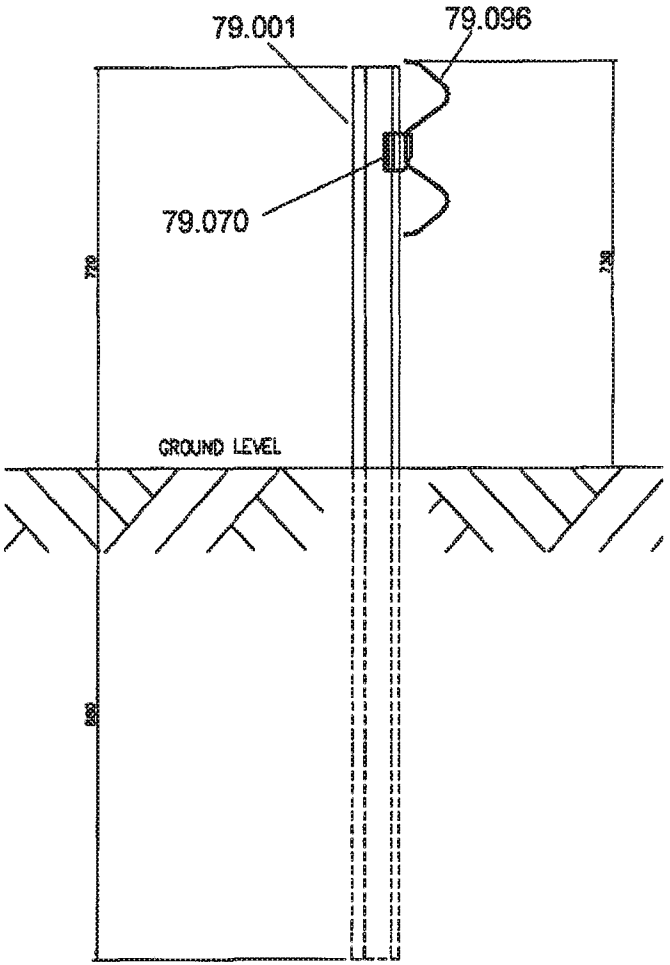
FIG. 79 is a side elevation view of an assembled barrier assembly with the carriage and post combination of FIG. 69.

As shown in FIG. 79, the post 79.001 can have an above ground portion that is approximately 750 mm, and an underground part that is approximately 1050 mm. The top of the beam 79.096 can be located slightly below the top of the post, at approximately 730 mm from the ground.

Figure 80:
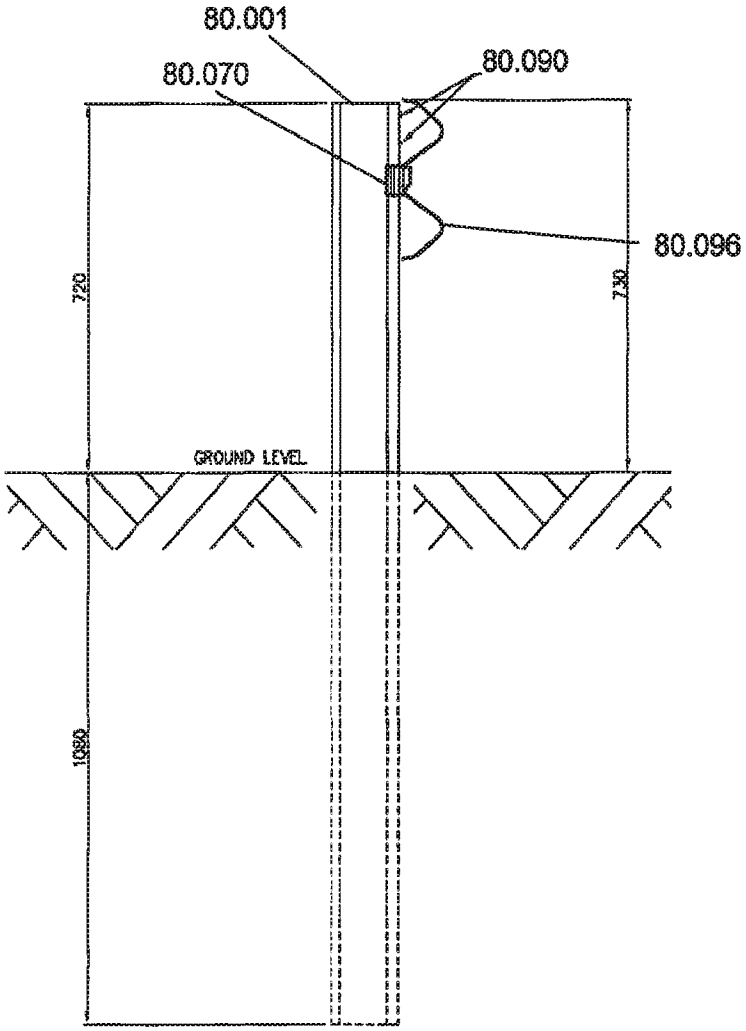
FIG. 80 is a side elevation view of an assembled barrier assembly with the carriage and post combination of FIG. 71.
Figure 82:
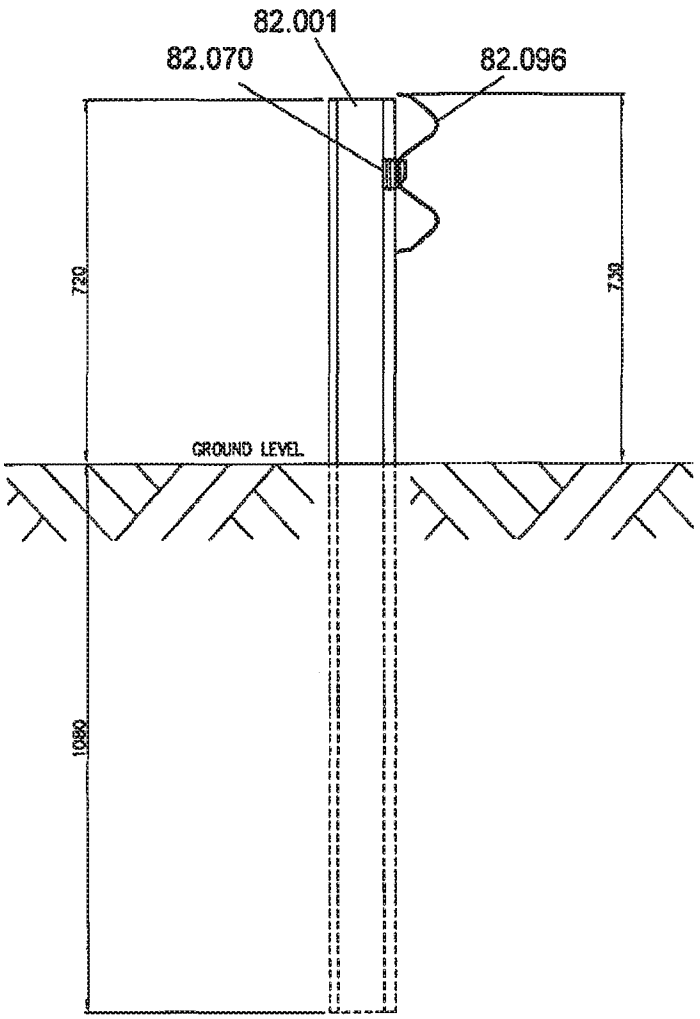
FIG. 82 is a side elevation view of an assembled barrier assembly with the carriage and post combination of FIG. 75.
Figure 81:
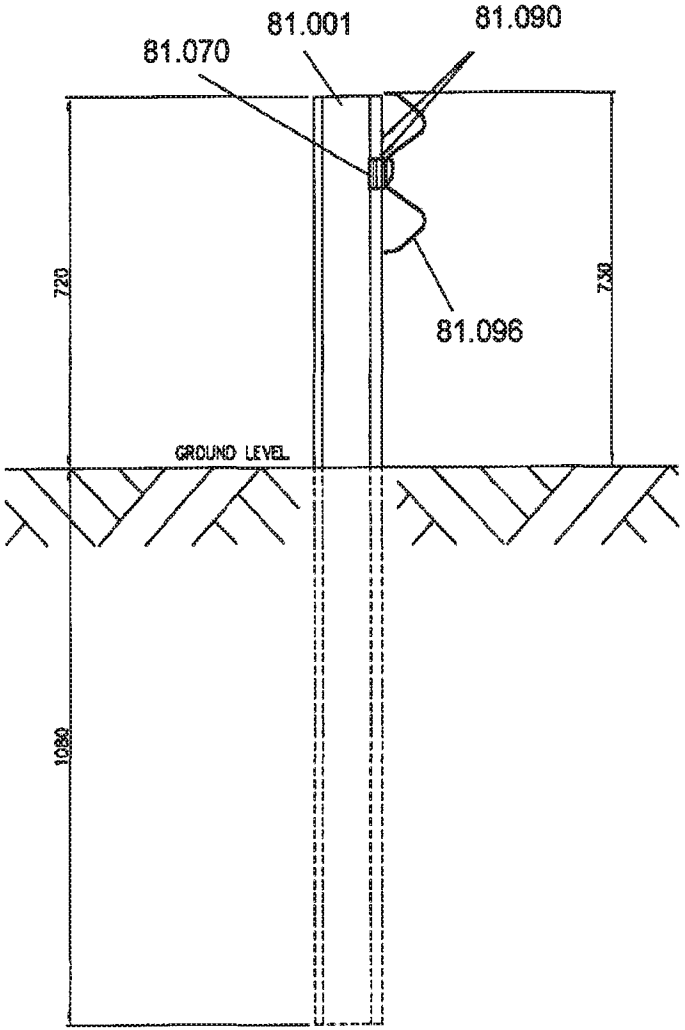
FIG. 81 is a side elevation view of an assembled barrier assembly with the carriage and post combination of FIG. 73.

As shown in FIGS. 80 to 82, the posts 80.001 and 81.001 can have an above ground portion that is approximately 720 mm, and an underground part that is approximately 1080 mm. The top of the beam 79.096 can be located slightly above the top of the post, at approximately 730 mm from the ground. The post depicted in FIG. 80 can have engagement means which are single projections as explained above with reference to for example FIG. 71. The post depicted in FIG. 81 can have engagement means which are friction tabs as described above with reference to FIG. 73. The post depicted in FIG. 82 can have one or more shear pins as described with reference to FIG. 75. The post depicted in FIG. 82 can also be used for frictional engagement with the bolt of the carriage, as described above with reference to FIG. 77.

The depth to which the posts are inserted into the ground is a function of their cross-section shape, dimensions and the gauge of metal from which they are made. Once a vehicle collides with a post, that post will bend and deform to a depth of the post until such a depth where the earth will resist the bending forces. However, the depth need only be deep enough so that the lower part of the post will not bend. To have the post extend too far beyond this depth is to waste post material. For the post of FIG. 79 the depth is 1050 mm. For the post of FIGS. 80 to 82, the depth is approximately 1080 mm. For other size posts other depths will be appropriate.

FIGS. 1A to 1D illustrate various views of a cap for a Z post. The cap 1.002 includes a cover portion 1.008 which has a bevelled edge 1.010. The cover is in the form of a "serifed" I with broad ends 1.004 (end A), 1.006 (end B) and a narrower central portion. Underside projections 1.012, 1.014 are shown in doted outline in FIG. 1A.

FIG. 1B is a top end view of the cap showing the downwardly extending skirt 1.012 and attachment tab 1.016 with fastening hole 1.018.

FIG. 1C is a side view of the cap which shows both skirts 1.012 and 1.014, the tab 1.016 being attached to skirt 1.106.

FIG. 1D shows the lower end view of the cap.

FIG. 1E shows the underside of the cap with the skirts 1.012 and 1.014 shown conforming to portions of the cross section of a Z post 1.001 shown in dashed line to indicate it is not part of the cap. The two skirts 1.012 and 1.014 are hook-shaped, with oblique stems which overlap to form a channel 1.020 therebetween. the channel 1.020 is adapted to receive at least a portion of the oblique segment of the Z post.

FIGS. 2 and 3 are perspective illustrations of the cap of FIG. 1 showing the attachment tab 2.016, 3.016 depending from below the cover 2.002, 3.002. The tab is attached to skirt 2.012 (see FIG. 1C).

FIGS. 4 and 5 show opposite views of the cap 4.002, 5.002 attached to a Z post 4.001, 5.001. The attachment tab 4.016 extends down adjacent to, and parallel with, the oblique portion 5.050 of the Z post. The oblique portion 5.050 of the Z post has a hole adapted to receive the bolt of nut and bolt attachment 4.022, 5.022, the post attachment hole being located so that the tab attachment hole 2.018 is aligned with the post hole while the underside of the cap is located on the top of the Z post. Thus, the cap is held stable because of the contact between the underside of the cap and the top of the post, while the fastening holds the cap in place. The skirts 2.012, 2.014 also assist in locating the cap on the post end.

In the assembly shown in FIGS. 4 and 5, the edges of the ends of the cap are flush with the vertical sides of the top and tail of the Z-post. This permits other connections to be slid on and off the post without interference from the cap.

FIGS. 6 and 7 illustrate a combined cap and delineator, wherein the attachment is similar to that of the arrangement of FIGS. 1 to 5, with the addition of a delineator 6.030 to the top of the cap 6.002. The delineator has at least one reflective face 6.032. As shown in FIG. 7, when the delineator and cap assembly is attached to a Z post 7.001 using the bolt fastening arrangement 7.022 to connect the tab 7.016 to the oblique portion of the Z post, this arrangement provides a means for having the delineator aligned transversely to the parallel ends of the Z post and skewed in relation to the oblique portion of the Z post, so that the reflective faces of the delineator face oncoming traffic.

FIGS. 8 to 12 illustrate another delineator attachment arrangement. This arrangement is similar to that of FIGS. 6 and 7 with the cap replaced by a small end engagement segment 8.024, 8.026 seen, for example, in the top end view FIG. 8A. The engagement segments 8.024, 8.026 are wedge-shaped with their apexes adjacent. The attachment tab 8.016 is affixed to the edge of the wedges. The wedges ensure that the attachment holes 8.08, 8.019 align with corresponding holes on the Z post 12.001. The wedges 8.024 and 8.026 can be of unequal size or of equal size. The unequal size can be used to assist in ensuring the delineators are installed with the correct orientation, so the correct faces are visible to oncoming traffic.

FIG. 8B shows the delineator 8.032 and attachment tab 8.016. The plane of the delineator 8.030 and the plane of the attachment tab 8.016 can be seen to be skewed around a common axis in the remaining FIGS. 8A, 8C, and 8D, as well as in FIGS. 9 & 10.

As seen in the lower end view FIG. 8D, the attachment tab 8.016 is off-set from the symmetrical center of the arrangement, to allow for the width of the oblique portion of the Z post.

Figure 12:
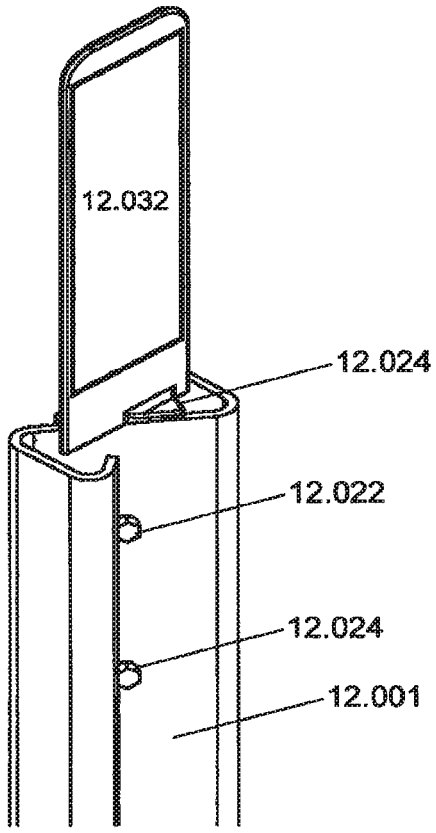
FIG. 12 shows a second view of the delineator arrangement attached to a Z post.
Figure 16:
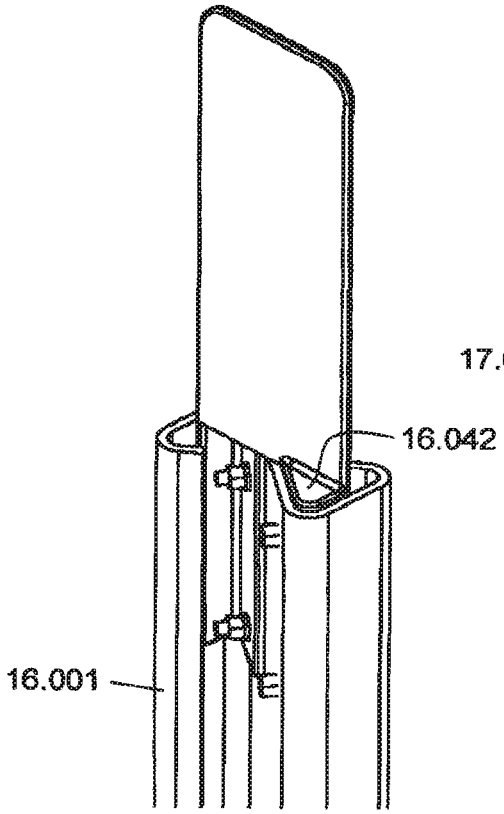
FIG. 16 Is a perspective side view of the delineator of FIG. 14 applied to a Z-post.
Figure 17:
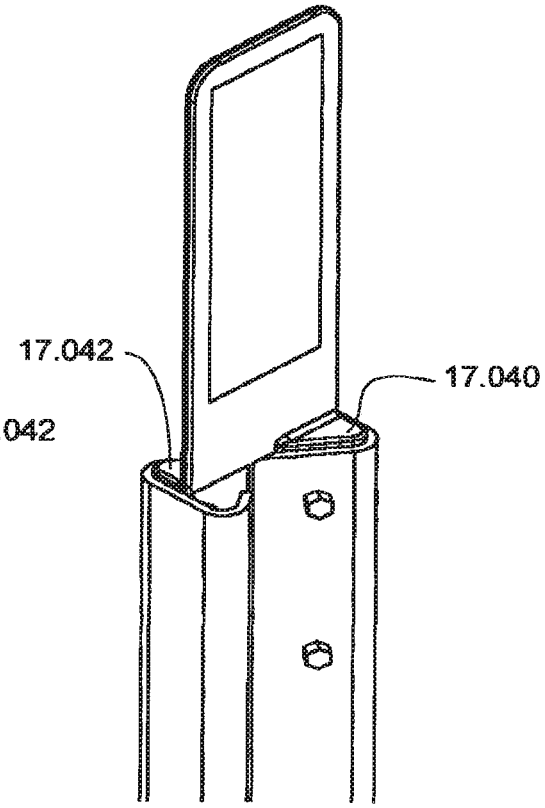
FIG. 17 Is a perspective side view of the delineator of FIG. 15 applied to a Z-post.

The attachment tab is provided with two attachment holes 8.018, 8.019. Thus, as shown in FIGS. 11 and 12, two fastening bolts can be used to attaché the delineator arrangement to the Z post 12.001.

FIGS. 13 to 17 illustrate a delineator attachment arrangement, wherein the attachment tabs 13.034, 13.036, are shaped to conform to an end portion of a Z post, and are also dimensioned to be a sliding fit inside the end portions of a Z post. The tops of the attachment tabs 13.034, 13.036 are closed by transverse segments 14.42, 15.40. However, these transverse segments do not form engagement elements as they are of a size to fit within the ends of the Z post. Compared with the arrangement shown in FIG. 12, it is seen that the transverse segments fully occlude the inner space at the top of the Z-post, whereas, in FIG. 12, there is a gap between the end of the transverse segment and the tail of the Z-post cross-section.

Figure 21:
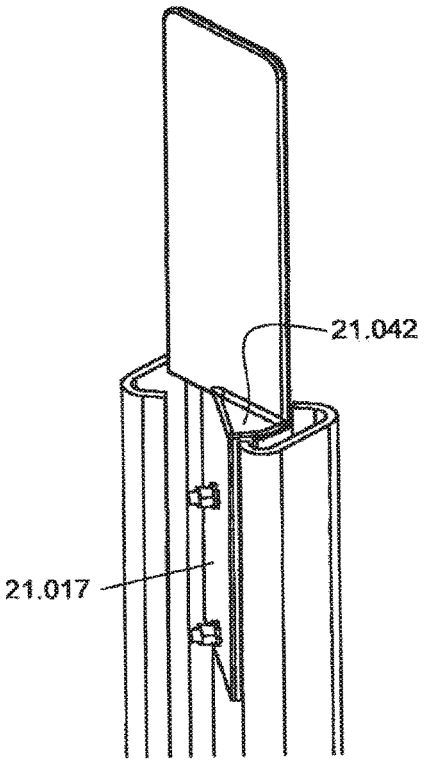
FIG. 21 shows the delineator of FIG. 19 applied to a Z-post.
Figure 22:
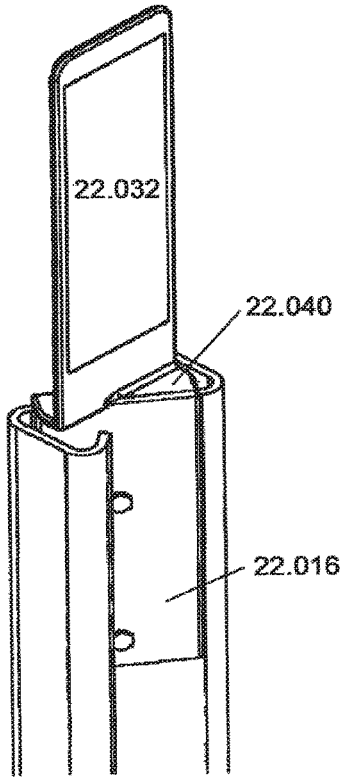
FIG. 22 shows the delineator of FIG. 20 applied to a Z-post.

As shown in FIG. 13E, the attachment tabs 13.034, 13.036 are spaced to leave a passage 13.038, 14.038, 15.038 through which the oblique segment of a Z post cross-section can pass, while the stems of the attachment tabs are adapted to lie substantially parallel to, and on opposite sides of the oblique segment of the Z post. The stems of the attachment tabs do not overlap to facilitate the attachment bolts to be inserted and fastened as shown in FIGS. 21 & 22. The shape of the attachment tabs assists in providing location of the delineator and the attachment holes can be located so that they align with the corresponding holes in the Z post when the base of the delineator rests on the end of the post at the top of the passage 15.038.

FIGS. 18 to 22 illustrate another delineator attachment arrangement, two parallel attachment tabs 18.016, 18.017 are provided to form the attachment channel 18.044, 19.044. The attachment tabs can include aligned attachment holes so a bolt can be inserted through both tabs and the Z post.

In this arrangement, the channel 19.044 can be symmetrically arranged. As seen in FIGS. 19 and 20 the tab 19.017 is attached to the outer edge of wedge 19.042 while the tab 19.016 is offset sufficiently to receive the oblique portion of the Z post, while the tab 20.016 is attached to the edge of the wedge 20.040, and the other tab (not shown is offset from the edge of the wedge 20.040 to form the Z post channel.

FIGS. 21 and 22 show the delineator of FIGS. 18 to 20 attached to a Z-post. The intersecting planes of the delineator 21.032 and the mounting bracket plates 21.017, 22.017 are adapted to permit the delineator to align with the Z-post major direction, which, in use, results in the reflective faces of the delineator facing oncoming traffic.

FIGS. 23 and 24 illustrate a Z-post end cap 23.052 having a downwardly extending external skirt 23.060 adapted to fit over the edges of the cross-section of a Z-post. The end cap has pair of end sections 23.054, 23.056 which conform to the ends of a Z-post and a waisted middle section 23.058 which is not in engagement with the Z-post. The skirt is a close fit over the ends of the Z-post and follows the trailing ends 23.062, 23.064 of the Z-post for at least part of their length. This provides a cover for the metal edges of the end of the Z-post.

If desired, the end cap of FIGS. 23 and 24 can have securement arrangements similar to those of FIGS. 1 to 5.

FIG. 25 illustrates an end cap similar to that of FIGS. 23 and 24, with a slot 25.066. Slot 25.006 is adapted to fit over a delineator such as that shown in FIGS. 21 and 22. Thus, the metal edges of the Z-post can be covered while a delineator is still visible to oncoming traffic.

Figure 26:
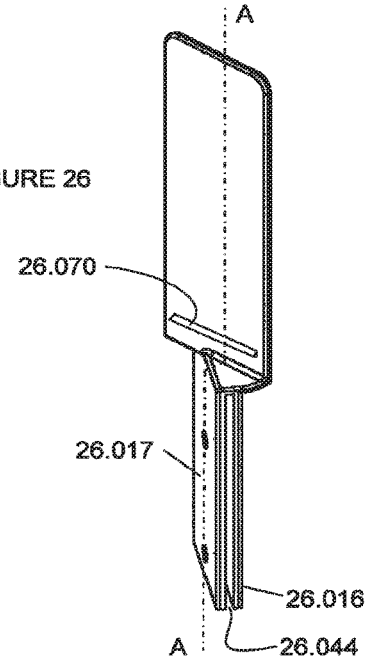
FIG. 26 shows a modified version of the delineator having snap fit projections.
Figure 27:
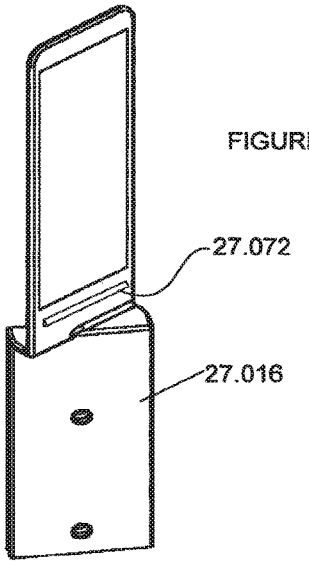
FIG. 27 shows the opposite side of the delineator of FIG. 25.

FIGS. 26 and 27 illustrate a further delineator adapted to cooperate with the modified cap of FIG. 25. The delineator of FIGS. 26 and 27 has a pair of snap-fit projections 26.070, 27.072 adapted to engage with the slot 25.066.

The snap fit projections can have a substantially triangular cross-section so they can be press fitted through the slot 25.066. The bases of the snap fit projections are spaced from the transverse portions of the delineator to permit the thickness of the cap top 25.052 to be accommodated therebetween, but the opposite ends of the bases of the triangles are separated by a greater width then the width of the slot, so they will resist separation of the delineator and the cap once the delineator has been inserted through the slot 25.055 and the snap-fit projections press fitted through the slot to engage with the top surface of the cap 25.052.

Figure 28:
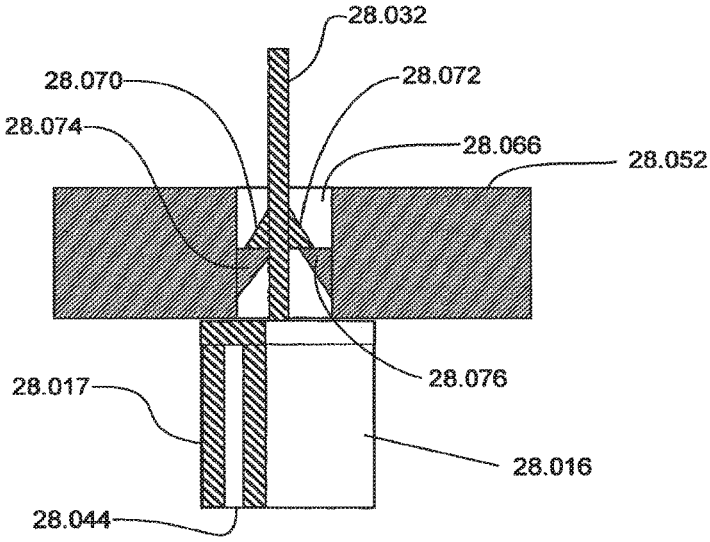
FIG. 28 is a partial cross-sectional illustration along line A-A of FIG. 26.

Alternatively, as shown in the partial cross-section view of FIG. 28, the slot 28.066 can be wider than the bases of the delineator snap-fit projections, and additional snap-fit projections 28.074, 28.076 can be provided inside the slot 28.066.

Figure 29:
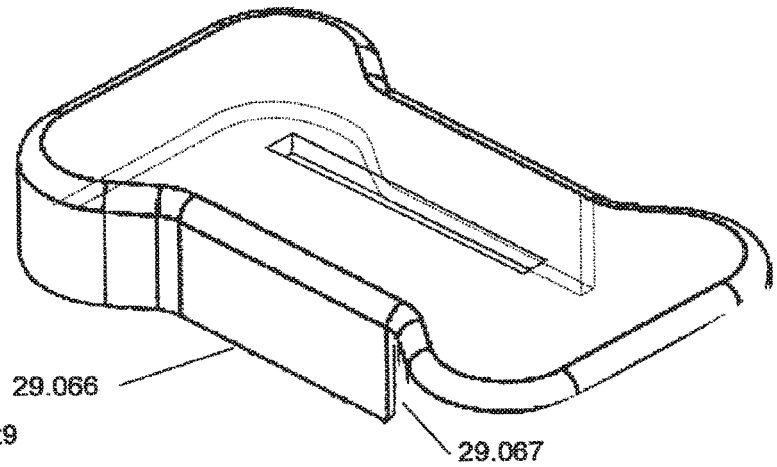
FIG. 29 shows a modification of the cap of FIG. 25.

As shown in FIG. 29, the skirt 29.060 extends only part way around the periphery of the cap, and is truncated as shown at 29.067.

The delineators can have single sided or double sided reflective surfaces.

The reflectors can be tetrahedral plastic reflectors, luminescent paint or other suitable optical devices.

The delineators and caps can be made of plastics, metal or other suitable material. They can be formed of a single piece of material by moulding, metal forming or other suitable manufacturing process.

In this specification, reference to a document, disclosure, or other publication or use is not an admission that the document, disclosure, publication or use forms part of the common general knowledge of the skilled worker in the field of this invention at the priority date of this specification, unless otherwise stated.

In this specification, terms indicating orientation or direction, such as "top", "bottom", "up", "down", "vertical", "horizontal", "left", "right" "upright", "transverse" etc. are not intended to be absolute terms unless the context requires or indicates otherwise. These terms will normally refer to orientations shown in the drawings.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A method for forming a post for a roadway, guard rail or safety barrier system which has a beam and post construction, the post having a cross-section allowing a carriage mounting the beam to the post in use to slide along the post and at least one engagement means, the at least one engagement means hinders sliding movement of the carriage along the post, the method comprising:

feeding a sheet metal blank through one or more rolls to form the post having the cross-section;

cutting or slitting an outer face of the post to form at least one strip extending across the outer face of the post between two cuts or slits spaced apart in a longitudinal direction of the post; and plastically deforming the at least one strip from the outer face of the post to form the at least one engagement means without separating the at least one strip from the outer face so that the at least one strip extends outwards from the cross-section of the post, the at least one strip having opposed ends which remain connected to the outer face of the post and a central section which is proud of the outer face of the post which faces, in use, the carriage securing the beam to the post.

2. The method for forming the post as claimed in claim 1, the method further comprising stretching the strip with a predetermined width, the width being measured in a direction along a longitudinal axis of the post, so that the plastic deformation of the strip occurs.

3. The method for forming the post as claimed in claim 1, the method further comprising stretching the strip with a predetermined width, the width being measured in a direction along a longitudinal axis of the post, so that the plastic deformation of the strip occurs, and the strip is stretched within a tensile strength of a material of the post.

4. The method for forming the post as claimed in claim 1, wherein the opposed ends are located toward a longitudinal axis of the post and the central section is located away from the longitudinal axis of the post.

5. The method for forming the post as claimed in claim 1, wherein the cross-section of the post is one of the following shapes: a Z shape; an I shape; a C shape; a rectangular shape; an H shape; a U shape; and an O shape.

6. The method for forming the post as claimed in claim 1, wherein the feeding, cutting or slitting, and plastically deforming are performed in that order.

7. A method for forming a post for a roadway, guard rail or safety barrier system which has a beam and post construction, the post having a cross-section allowing a carriage mounting the beam to the post in use to slide along the post, and at least one engagement means, the at least one engagement means hinders sliding movement of the carriage along the post, the method comprising:

cutting or slitting a sheet metal blank to form at least one strip between two spaced apart cuts or slits;

plastically deforming the at least one strip from the sheet metal blank to form the at least one engagement means without separating the at least one strip from the sheet metal blank so that the strip extends outwards from the sheet metal blank; and then feeding the sheet metal blank through one or more rolls to form the post having the cross-section, the rolls keeping clear of the at least one engagement means during roll forming the post so that the at least one strip extends across the outer face of the post with the two cuts or slits spaced apart in a longitudinal direction of the post, the at least one strip having opposed ends which remain connected to the outer face of the post and a central section which is proud of the outer face of the post which faces, in use, the carriage securing the beam to the post.

8. The method for forming the post as claimed in claim 7, wherein the method further comprising forming each of the at least one engagement means by stretching the strip with a predetermined width, the width being measured in a direction along a longitudinal axis of the post, so that the plastic deformation of the strip occurs.

9. The method for forming the post as claimed in claim 7, wherein the method further comprising forming each of the at least one engagement means by stretching the strip with a predetermined width, the width being measured in a direction along a longitudinal axis of the post, so that the plastic deformation of the strip occurs, and the strip is stretched within a tensile strength of a material of the post.

10. The method for forming the post as claimed in claim 7, wherein the opposed ends are located toward a longitudinal axis of the post and the central section is located away from the longitudinal axis of the post.

11. The method for forming the post as claimed in claim 7, wherein the cross-section of the post is one of the following shapes: a Z shape; an I shape; a C shape; a rectangular shape; an H shape; a U shape; and an O shape.

* * * * *